US010719022B2

(12) United States Patent
Kadokura et al.

(10) Patent No.: US 10,719,022 B2
(45) Date of Patent: Jul. 21, 2020

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yasuo Kadokura, Kanagawa (JP); Atsushi Sugawara, Kanagawa (JP); Daisuke Tomita, Kanagawa (JP); Sakiko Hirai, Kanagawa (JP); Satoshi Miura, Kanagawa (JP); Akira Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/103,330

(22) Filed: Aug. 14, 2018

(65) Prior Publication Data

US 2019/0294062 A1 Sep. 26, 2019

(30) Foreign Application Priority Data

Mar. 22, 2018 (JP) ..... 2018-054919
Mar. 22, 2018 (JP) ..... 2018-054920
Mar. 22, 2018 (JP) ..... 2018-054921

(51) Int. Cl.

| | |
|---|---|
| ***G03G 9/08*** | (2006.01) |
| ***G03G 9/087*** | (2006.01) |
| ***G03G 9/097*** | (2006.01) |
| ***G03G 9/093*** | (2006.01) |

(52) U.S. Cl.

CPC ..... *G03G 9/0821* (2013.01); *G03G 9/0825* (2013.01); *G03G 9/08711* (2013.01); *G03G 9/08782* (2013.01); *G03G 9/09364* (2013.01); *G03G 9/09378* (2013.01); *G03G 9/09392* (2013.01); *G03G 9/09725* (2013.01)

(58) Field of Classification Search

None

See application file for complete search history.

(56) References Cited

U.S. PATENT DOCUMENTS 9,678,449 B2 * 6/2017 Murakami ..... G03G 9/0825
2013/0071781 A1 * 3/2013 Saito ..... G03G 9/0812 430/105

FOREIGN PATENT DOCUMENTS

JP 09-197714 A 7/1997
JP 2862827 B2 3/1999

* cited by examiner

*Primary Examiner* — Mark A Chapman

(74) *Attorney, Agent, or Firm* — Sughrue Mion, PLLC

(57) ABSTRACT

An electrostatic charge image developing toner has a surface property index value represented by Formula S of 2.0 to 2.8, an electrostatic charge image developing toner has a surface property index value represented by Formula S of more than 2.8 and 3.5 or less, and an electrostatic charge image developing toner has a surface property index value represented by Formula S of more than 1.0 and less than 2.0 and a calculated value of a specific surface area in Formula S of 0.70 to 1.3:

(Surface property index value)=(Measured value of specific surface area)/(Calculated value of specific surface area) Formula S wherein (Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}.

9 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2018-054919 filed on Mar. 22, 2018, Japanese Patent Application No. 2018-054920 filed on Mar. 22, 2018, and Japanese Patent Application No. 2018-054921 filed on Mar. 22, 2018.

BACKGROUND

(i) Technical Field

The present invention relates to an electrostatic charge image developing toner, an electrostatic charge image developer, and a toner cartridge.

(ii) Related Art

Methods for visualizing image information via electrostatic charge images, such as electrophotography, are currently used in various fields.

In the related art, an electrophotographic method generally include a method of visualizing through plural steps of: forming an electrostatic latent image on a photoreceptor or an electrostatic recording member by various means; attaching electrostatic charge particles called toner to the electrostatic latent image to develop the electrostatic latent image, thereby obtaining a toner image; transferring the toner image to the surface of a transfer medium; and fixing the image by heating or the like.

JP-A-9-197714 discloses a developer including a binder resin and a colorant, in which in a case where developer particles are suspended in an aqueous solution, the developer particles in the suspension are imaged as a stationary image while passing the suspension, and an equivalent circle diameter and a circularity of the developer particles are obtained from a projected area a perimeter of the particle image by image analysis, a ratio B/A of a 50% average diameter A to 10% average diameter B of the developer particles is 40% to 80%, an average circularity is from 0.93 to 1.0, and a ratio of the circularity of 0.85 or less is 3.0% or less.

SUMMARY

Aspects of non-limiting embodiments of the present disclosure relate to an electrostatic charge image developing toner that prevents deletion and gloss unevenness of an image from occurring as compared with a case where a surface property index value represented by Formula S is less than 2.0 or more than 2.8, an electrostatic charge image developing toner that is excellent in rub resistance of an image as compared with a case where the surface property index value represented by Formula S is 2.8 or less or more than 3.5 and an electrostatic charge image developing toner that prevents color difference of an obtained image from varying as compared with a case where the surface property index value represented by Formula S is 1.0 or less or 2.0 or more, or in a case where a calculated value of a specific surface area in Formula S is less than 0.70 or more than 1.3, which correspond to the following first to third aspects, respectively.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to a first aspect of the present disclosure, there is provided an electrostatic charge image developing toner having a surface property index value represented by Formula S of 2.0 to 2.8:

(Surface property index value)=(Measured value of specific surface area)/(Calculated value of specific surface area) Formula S wherein (Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}.

According to a second aspect of the present disclosure, there is provided an electrostatic charge image developing toner having a surface property index value represented by Formula S described above of more than 2.8 and 3.5 or less.

According to a third aspect of the present disclosure, there is provided an electrostatic charge image developing toner having a surface property index value represented by Formula S described above of more than 1.0 and less than 2.0 and a calculated value of a specific surface area in Formula S described above is from 0.70 to 1.3.

BRIEF DESCRIPTION OF THE DRAWINGS

Exemplary embodiments of the present invention will be described in detail based on the following figures, wherein.

DETAILED DESCRIPTION

Figure 1:
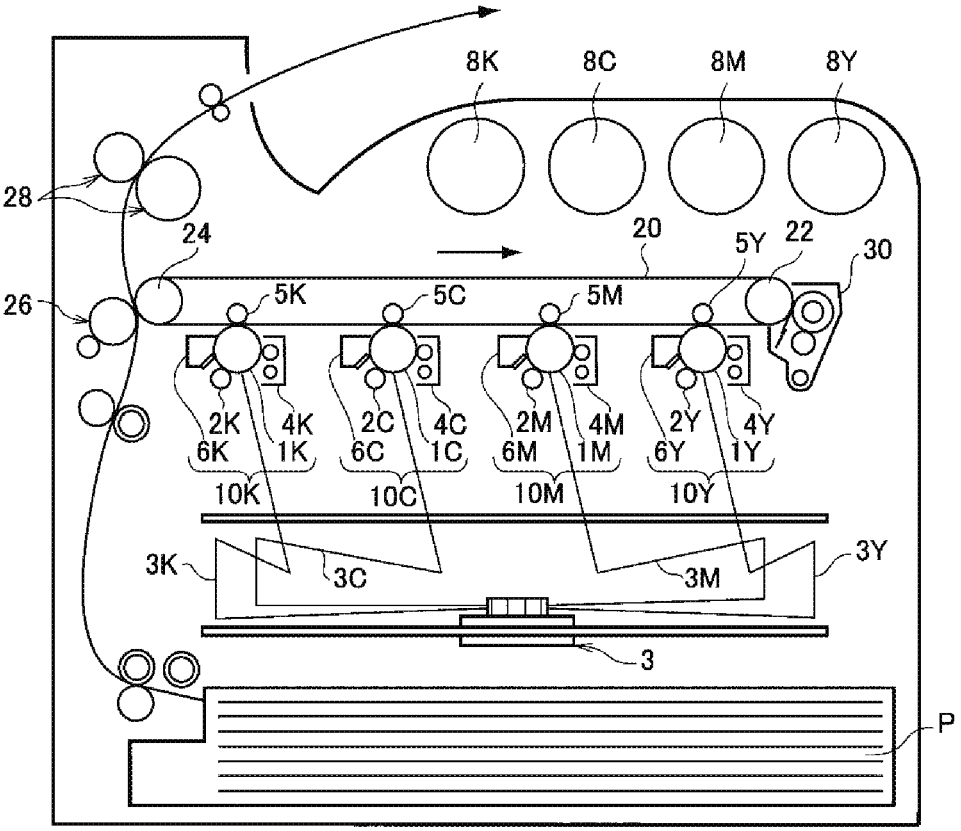
FIG. 1 is a configuration diagram illustrating an image forming apparatus according to the present exemplary embodiment.

In the specification, when referring to the amount of each component in a composition, in a case where plural kinds of substances corresponding to each component in the composition are present, unless otherwise specified, the amount of each component in a composition means a total amount of the plural kinds of the substances.

In the specification, an "electrostatic charge image developing toner" is simply referred to as a "toner" and an "electrostatic charge image developer" is simply referred to as a "developer".

Hereinafter, Embodiment X according to the first aspect will be described.

<Electrostatic Charge Image Developing Toner>

In an electrostatic charge image developing toner according to Embodiment X, a surface property index value represented by Formula S is from 2.0 to 2.8:

(Surface property index value)=(Measured value of specific surface area)/(Calculated value of specific surface area) Formula S wherein (Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}.

In a toner of the related art, since external additives may not be transferred by a mechanical load inside a developing unit and exposure of surfaces of toner base particles is reduced, in a case where after continuous printing is performed to stabilize a temperature of a fixing unit, printing is performed on a recording medium with a high basis weight under a high humidity environment, heat is absorbed by the recording medium and heat is not sufficiently applied to the toner. In particular, a flaking defect occurs with respect to tertiary colors, and an image may be whitish in some cases.

In addition, as a method of confirming surface properties of an electrostatic charge image developing toner, a method of measuring and calculating a specific surface area and the like by Coulter counter is known, but a method using flow particle image analysis (FPIA) is more excellent.

In the electrostatic charge image developing toner according to Embodiment X, deletion and gloss unevenness of an image is prevented from occurring by the configurations. The reason for this is not certain but is presumed as shown below.

Since the surface property index value is from 2.0 to 2.8, the toner surface has appropriate irregularities. The external additive is easily transferred by the mechanical load in the developing unit, and the surfaces of the toner base particles are easily exposed. In addition, in a case of containing a release agent, since the release agent is easily bleeding during fixing, in particular, a fixing temperature may be lowered. Therefore, it is presumed as follows. Even in a case of printing on the recording medium with a high basis weight under a high humidity environment, a flaking defect is prevented from occurring with respect to tertiary colors. As a result, deletion in the image are prevented from occurring and a structure of the toner surface is relatively uniform, and the fixing behavior of the toner is easy to be uniform. Therefore, the electrostatic charge image developing toner in which gloss unevenness of the image is prevented from occurring.

Hereinafter, the electrostatic charge image developing toner according to Embodiment X will be described in detail.

[Surface Property Index Value]

In an electrostatic charge image developing toner according to Embodiment X, a surface property index value represented by Formula S is from 2.0 to 2.8.

(Surface property index value)=(Measured value of specific surface area)/(Calculated value of specific surface area) Formula S The measured value of a specific surface area of the toner in Embodiment X is a value measured by a nitrogen adsorption method. Specifically, the measured value of a specific surface area is measured by a one point method of the nitrogen adsorption method using a BET equation. An equilibrium relative pressure is set to 0.3.

The calculated value of a specific surface area of the toner in Embodiment X is calculated by the following formula.

(Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}

The flow particle image analysis (FPIA) in calculation of the calculated value of a specific surface area is measured with a flow particle image analyzer (FPIA-3000 manufactured by Sysmex Corporation).

In this device, a method of measuring particles dispersed in water or the like by flow particle image analysis is adopted, and the aspirated particle suspension is guided to a flat sheath flow cell to form a flaky sample flow by a sheath liquid. The particles passing through are imaged as a still image with a charge coupled device (CCD) camera, through an objective lens, by irradiating the sample flow with strobe light. The captured particle image is subjected to a two-dimensional image processing to calculate the equivalent circle diameter from a projected area. Regarding the equivalent circle diameter, for each of 4,500 toner particles, image analysis is performed and statistical processing is performed to obtain the equivalent circle diameter. A sum of surface areas calculated from the equivalent circle diameters of 4,500 toner particles and a sum of volumes calculated from the equivalent circle diameter of 4,500 toner particles are obtained.

In the measurement by the flow particle image analysis, a high resolution mode (HPF mode) is used and a dilution magnification is set to 1.0 time.

In addition, the specific gravity of the toner is measured using a Gay-Lussac's type pycnometer with reference to 8.2.2 of JIS-K-0061.

In the electrostatic charge image developing toner according to Embodiment X, the surface property index value represented by Formula S is preferably from 2.1 to 2.7, more preferably from 2.2 to 2.6, and particularly preferably from 2.3 to 2.5, from the viewpoint of preventing deletion and gloss unevenness of an image from occurring. When the surface property index value is within the above range, the structure of the surface is relatively uniform and the fixing behavior of the particles is easy to be uniform. Therefore, it is easy to prevent the gloss unevenness from occurring.

As a method of controlling the surface property index value, for example, when coalescing aggregated particles containing resin particles, the surface property index may be controlled by appropriately adjusting a temperature, pH, or the like.

In the electrostatic charge image developing toner according to Embodiment X, the melt viscosity of the toner as measured by the flow tester method at a load of 10 kgf/cm$^2$ is preferably from 90° C. to 140° C., more preferably from 95° C. to 130° C., still more preferably from 98° C. to 125° C., and particularly preferably from 105° C. to 115° C., from the viewpoint of preventing deletion and gloss unevenness of an image from occurring.

In a method of measuring the melt viscosity of the toner in Embodiment X, a viscosity at a temperature corresponding to ½ of a height of an end point from a flow start point when a 1 cm$^3$ sample is melted and flowed out is obtained using a Koka type flow tester CFT-500 (manufactured by Shimadzu Corporation) under conditions that a pore diameter of a die is 0.5 mm, a pressure load is 10 kgf/cm$^2$, and a temperature rising rate is 1° C./min.

With respect to the electrostatic charge image developing toner according to Embodiment X, a content of aluminum atoms by fluorescent X-ray analysis is preferably from 0.005 kcps to 0.35 kcps, more preferably from 0.02 kcps to 0.30 kcps, and particularly preferably from 0.05 kcps to 0.20 kcps, from the viewpoint of preventing deletion and gloss unevenness of an image from occurring.

In a method of measuring a content of the aluminum atoms by the fluorescent X-ray analysis according to Embodiment X, a net intensity of an aluminum atom content in the toners is measured with respect to the toner by using a fluorescent X-ray analyzer (scanning fluorescent X-ray analyzer, ZSX Primus II, manufactured by Rigaku Corporation). As a sample pretreatment, 0.1 g to 0.2 g of toner is press-formed to have a disc-shape, and then measurement is performed under conditions of a tube voltage of 40 kV, a tube current of 70 mA, and a measurement time of 15 minutes, by a qualitative quantitative measurement.

The content of aluminum atoms in the toner is adjusted, for example, by using an aluminum aggregating agent used for preparing the toner.

The toner according to Embodiment X includes toner particles (also referred to as "toner base particles") and, as needed, an external additive.

[Toner Particle]

The toner particles contain, for example, a binder resin, and as needed, a colorant, a release agent, and other additives, and preferably contain a binder resin and a release agent.

In Embodiment X, the toner particles may be white toner particles, transparent toner particles, brilliant toner particles or the like, besides toner particles such as yellow toner, magenta toner, cyan toner, and black toner, and is not particularly limited.

<Binder Resin>

Examples of the binder resin include a vinyl resin such as homopolymers of monomers such as styrene (such as styrene, parachlorostyrene, and α-methylstyrene), (meth) acrylate esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or a copolymer of two or more of these monomers.

Examples of the binder resin also include a non-vinyl resin such as an epoxy resin, a polyester resin, a polyurethane resin, a polyamide resin, a cellulose resin, a polyether resin, and a modified rosin, a mixture of these non-vinyl resins and the vinyl resin, or a graft polymer obtained by polymerizing vinyl monomers in the presence of the non-vinyl resin.

Among these, the styrene acrylic resin is preferably used.

One kind of these binder resins may be used alone and two or more kinds thereof may be used in combination.

As the binder resin, a polyester resin is preferable. Examples of the polyester resin include a condensation polymer of a polyvalent carboxylic acid and a polyol.

Examples of the polycarboxylic acid include an aliphatic dicarboxylic acid (such as oxalic acid, malonic acid, maleic acid, fumaric acid, citraconic acid, itaconic acid, glutaconic acid, succinic acid, alkenylsuccinic acid, adipic acid, and sebacic acid), an alicyclic dicarboxylic acid (such as cyclohexanedicarboxylic acid), and aromatic dicarboxylic acids (such as terephthalic acid, isophthalic acid, phthalic acid, and naphthalenedicarboxylic acid), an anhydride thereof, and a lower (for example, 1 to 5 carbon atoms) alkyl esters thereof. Among these, as the polyvalent carboxylic acid, for example, the aromatic dicarboxylic acid is preferable.

As the polyvalent carboxylic acid, a trivalent or higher valent carboxylic acid having a crosslinked structure or a branched structure may be used in combination with dicarboxylic acid. Examples of the trivalent or higher valent carboxylic acid include trimellitic acid, pyromellitic acid, anhydrides thereof, or lower (for example, 1 to 5 carbon atoms) alkyl esters thereof.

One kind of polyvalent carboxylic acids may be used alone and two or more kinds thereof may be used in combination.

Examples of the polyol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). Among these, as the polyol, for example, an aromatic diol and an alicyclic diol are preferable, and the aromatic diol is more preferable. As the polyol, a trihydric or higher polyol having a crosslinked structure or a branched structure may be used in combination with dihydric alcohol. Examples of trihydric or higher polyols include glycerin, trimethylolpropane, and pentaerythritol. One kind of polyols may be used alone and two or more kinds thereof may be used in combination.

A glass transition temperature (Tg) of the polyester resin is preferably from 50° C. to 80° C., and more preferably from 50° C. to 65° C.

The glass transition temperature is obtained from the DSC curve obtained by differential scanning calorimetry (DSC). More specifically, the glass transition temperature is obtained "extrapolated starting temperature of glass transition" described in "method of obtaining glass transition temperature" of JIS K 7121-1987 "method of measuring plastic transition temperature".

A weight average molecular weight (Mw) of the polyester resin is preferably from 5,000 to 1,000,000, and more preferably from 7,000 to 500,000. A number average molecular weight (Mn) of the polyester resin is preferably from 2,000 to 100,000. A molecular weight distribution Mw/Mn of the polyester resin is preferably from 1.5 to 100, and more preferably from 2 to 60.

The weight average molecular weight and the number average molecular weight of the polyester resin are measured by gel permeation chromatography (GPC). The molecular weight measurement by GPC is performed with THF solvent using GPC.HLC-8120 GPC (manufactured by Tosoh Corporation), as a measuring device and a column.TSK gel Super HM-M (15 cm) (manufactured by Tosoh Corporation). The weight average molecular weight and the number average molecular weight are calculated from the measurement result, using a molecular weight calibration curve prepared by using a monodisperse polystyrene standard sample.

The polyester resin is obtained by a known producing method. Specifically, for example, the polyester resin is obtained by a method in which a polymerization temperature is from set from 180° C. to 230° C., and as needed, a reaction system is depressurized, and reaction is performed while removing water or alcohol generated during the condensation.

In a case where the raw material monomers are not dissolved or incompatible with each other at the reaction temperature, a solvent having a high boiling point may be added as a dissolution aid to dissolve the raw material monomers. In this case, the polycondensation reaction is performed while the dissolution aid is distilled off. In a case where monomers with poor compatibility are present, the monomers having poor compatibility are condensed with acid or alcohol to be polycondensed with the monomer in advance and then polycondensed with the main component.

The content of the binder resin is preferably from 40% by weight to 95% by weight, more preferably from 50% by weight to 90% by weight, and still more preferably from 60% by weight to 85% by weight, with respect to the whole toner particles.

In addition, the content of the binder resin in a case of using the white toner particles as toner particles is preferably from 30% by weight to 85% by weight with respect, and more preferably from 40% by weight to 60% by weight, with respect to the whole white toner particles.

<Release Agent>

Examples of the release agent include hydrocarbon wax; natural waxes such as camauba wax, rice wax, and candelilla wax; synthetic or mineral/petroleum wax such as montan wax; and ester wax such as fatty acid ester and montanic acid ester. The release agent is not limited thereto.

A melting temperature of the release agent is preferably from 50° C. to 110° C., more preferably from 65° C. to 100° C., still more preferably from 70° C. to 95° C., and particularly preferably from 75° C. to 90° C., from the viewpoint of preventing the deletion and gloss unevenness of an image from occurring.

The melting temperature of the release agent is obtained from a DSC curve obtained by differential scanning calorimetry (DSC), by "melting peak temperature" described in "method of obtaining melting temperature" of JIS K 7121-1987 "method of measuring plastic transition temperature".

In the electrostatic charge image developing toner according to Embodiment X, when the number of the release agents having an aspect ratio of 5 or more in the toner is taken as a, and the number of the release agents having an aspect ratio of lower than 5 in the toner is taken as b, a relation thereof satisfies preferably $1.0<a/b<8.0$, more preferably $2.0<a/b<7.0$, and particularly preferably $3.0<a/b<6.0$, from the viewpoint of preventing deletion and gloss unevenness of an image from occurring.

In addition, in the electrostatic charge image developing toner according to Embodiment X, when an area of the release agents having an aspect ratio of 5 or more in a toner section (toner particle section) is taken as c, and an area of the release agents having an aspect ratio of lower than 5 in the toner section is taken as d, a relation thereof satisfies preferably $1.0<c/d<4.0$, more preferably $1.5<c/d<3.5$, and particularly preferably $2.0<c/d<3.0$ from the viewpoint of preventing deletion and gloss unevenness of an image from occurring.

As a method of measuring the aspect ratio of the release agent in the toner, the aspect ratio is measured by the following method.

The toner is mixed with the epoxy resin, followed by solidifying the epoxy resin. The obtained solidified product is cut with an ultramicrotome device (Ultracut UCT manufactured by Leica Microsystems) to prepare a flake sample having a thickness from 80 nm to 130 nm. Next, the flake sample is dyed with ruthenium tetroxide for 3 hours in a desiccator at 30° C. An SEM image of the dyed flake sample is obtained with an ultrahigh resolution field emission scanning electron microscope (FE-SEM) (for example, S-4800 manufactured by Hitachi High-Technologies Corporation). In general, since the release agent is more likely to be dyed with ruthenium tetroxide than the binder resin, the release agent is identified with shading caused by the degree of dying. In a case where it is difficult to distinguish the shading due to a state of the sample or the like, the dyeing time may be adjusted. In the toner particle section, since a colorant domain is generally smaller than a release agent domain, it is possible to be distinguished by diameters.

The SEM image includes toner particle sections of various diameters. Toner particle sections in which the diameter is 85% or more of the volume average particle diameter of the toner particles are selected, and among these, 100 toner particle sections are randomly selected to observe the selected sections. Here, the diameter of the toner particle section means the maximum length (so-called long diameter) drawn to certain two points on a contour line of the toner particle section.

In the SEM image, for each of 100 toner particle sections selected as above, image analysis is performed under a condition of 0.010000 μm/pixel using an image analysis software (WinROOF, manufactured by Mitani Corporation). Using this image analysis, images of the toner particle sections may be observed by luminance difference (contrast) between the epoxy resin used for embedding and the binder resin of the toner particles. Based on the observed images, length in a long axis direction of the release agent domain in the toner particle, a ratio (Length in long axis direction/Length in short axis direction), and the area may be determined.

A content of the release agent is preferably from 1% by weight to 20% by weight, and more preferably from 5% by weight to 15% by weight, with respect to the whole toner particles.

<Colorant>

Examples of the colorant include pigments such as carbon black, chrome yellow, hansa yellow, benzidine yellow, suren yellow, quinoline yellow, pigment yellow, permanent orange GTR, pyrazolone orange, vulcan orange, watch young red, permanent red, brilliant carmine 3B, brilliant carmine 6B, Dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate, titanium oxide, zinc oxide, calcium carbonate, basic lead carbonate, a zinc sulfide-barium sulfate mixture, zinc sulfide, silicon dioxide, aluminum oxide; and dyes such as acridine type, xanthene type, azo type, benzoquinone type, azine type, anthraquinone type, thioindigo type, dioxazine type, thiazine type, azomethine type, indico type, phthalocyanine type, aniline black type, polymethine type, triphenyl methane type, diphenylmethane type, and thiazole type.

In addition, in a case of using the white toner particles as the toner particles, white pigment may be used as the colorant.

As the white pigment, titanium oxide and zinc oxide are preferable, and titanium oxide is more preferable.

One kind of the colorant may be used alone and two or more kinds thereof may be used in combination.

As the colorant, if necessary, a surface-treated colorant may be used or the colorant may be used in combination with a dispersant.

A content of the colorant is preferably from 1% by weight to 30% by weight, and more preferably from 3% by weight to 15% by weight, with respect to the whole toner particles.

In addition, the content of pigment in a case of using the white toner particles as toner particles is preferably from 15% by weight to 70% by weight, and more preferably from 20% by weight to 60% by weight, with respect to the whole white toner particles.

<Other Additives>

Examples of other additives include known additives such as a magnetic material, a charge-controlling agent, and an inorganic powder. These additives are contained in the toner particles as internal additives.

<Properties or the Like of Toner Particle>

The toner particle may be a toner particle having a single layer structure, or may be a toner particle having a so-called core-shell structure configured by a core (core particle) and a coating layer (shell layer) that covers the core. The toner particle having the core-shell structure is, for example, configured by a core containing a binder resin and, as needed, a colorant, a release agent, and the like, and a coating layer containing a binder resin.

A volume average particle diameter (D50v) of the toner particles is preferably, from 2 μm to 10 μm, and more preferably from 4 μm to 8 μm.

A volume average particle diameter of the toner particles is measured by Coulter Multisizer II (manufactured by Beckman Coulter, Inc.) using ISOTON-II (manufactured by Beckman Coulter, Inc.) as an electrolytic solution.

When performing measurement, 0.5 mg to 50 mg of a measurement sample is added to 2 ml of a 5% by weight of aqueous solution of a surfactant (preferably sodium alkylbenzenesulfonate) as a dispersant. The mixture is added to 100 ml to 150 ml of an electrolytic solution.

The electrolytic solution in which the sample is suspended is subjected to a dispersion treatment for 1 minute with an ultrasonic disperser. Each particle diameter of the particles having a particle diameter from 2 μm to 60 μm is measured by Coulter Multisizer II using an aperture having an aperture diameter of 100 μm. The number of particles to be sampled is 50,000.

In the measured particle diameter, a cumulative volume-based distribution is drawn from a small diameter side, and the particle diameter at which the accumulation reaches 50% is defined as the volume average particle diameter D50v.

In Embodiment X, the average circularity of the toner particles is not particularly limited, but is preferably, from 0.91 to 0.98, more preferably from 0.94 to 0.98, and still more preferably from 0.95 to 0.97, from the viewpoint of improving cleaning property of the toner from the image holding member.

In Embodiment X, the circularity of the toner particles means (Perimeter of Circle Having Same Area As Particle Projected Image)+(Perimeter of Particle Projected Image), and the average circularity of the toner particle is a circularity at which a cumulative 50% is reached from the smaller side in the distribution of the circularity. The average circularity of the toner particles is obtained by analyzing at least 4,500 toner particles with a flow particle image analyzer.

In a case where the toner particles are produced by an aggregation coalescence method, the average circularity of the toner particles may be controlled, for example, by adjusting a stirring speed of the dispersion, a temperature of the dispersion, or keeping time in the coalescence step.

[External Additive]

Examples of an external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

A surface of the inorganic particles as the external additive may be treated with a hydrophobizing agent. Treating with the hydrophobizing agent is performed by immersing inorganic particles in the hydrophobizing agent. The hydrophobizing agent is not particularly limited, and examples thereof include a silane coupling agent, silicone oil, a titanate coupling agent, and an aluminum coupling agent. One kind of these may be used alone and two or more kinds thereof may be used in combination.

The amount of the hydrophobizing agent is preferably from 1 part by weight to 10 parts by weight with respect to 100 parts by weight of inorganic particles.

Examples of the external additive include a resin particle (resin particles such as polystyrene, polymethyl methacrylate (PMMA), and a melamine resin) and a cleaning aid (for example, metal salts of higher fatty acids represented by zinc stearate and particles of fluorinated polymer).

The amount of the external additive is, for example, preferably from 0.01% by weight to 10% by weight and more preferably from 0.01% by weight to 6% by weight, with respect to the toner particles.

[Preparing Method of Toner]

Hereinafter, a preparing method of toner according to Embodiment X will be described.

The toner according to Embodiment X is obtained by adding an external additive to toner particles after producing the toner particles.

The toner particles may be produced by any of a dry production method (such as a kneading and pulverizing method) and a wet production method (such as an aggregation coalescence method, a suspension polymerization method, and a dissolution suspension method). These production methods are not particularly limited, and known production methods are adopted. Among these, the toner particles may be obtained by an aggregation coalescence method.

Specifically, in a case where the toner particles are produces by the aggregation coalescence method, the toner particles are produced through a step of preparing a resin particle dispersion in which resin particles as a binder resin are dispersed (preparation step of resin particle dispersion), a step of aggregating the resin particles (other particles as needed) in the resin particle dispersion (in a dispersion after mixing other particle dispersions as needed) to form aggregated particles (aggregated particle forming step), and a step of heating an aggregated particle dispersion in which the aggregated particles are dispersed and coalescing the aggregated particles to form toner particles (coalescence step).

Hereinafter, each step will be described in detail.

In the following description, a method of obtaining toner particles containing a colorant and a release agent will be described, but a coloring agent and a release agent are used as needed. Other additives rather than the colorant and the release agent may be used of course.

<Preparation Step of Resin Particle Dispersion>

The resin particle dispersion in which resin particles are dispersed is prepared as follows, and for example, a colorant particle dispersion in which colorant particles as the binder resin are dispersed and a release agent particle dispersion in which release agent particles are dispersed may be also prepared.

The resin particle dispersion is prepared by dispersing resin particles in a dispersion medium by a surfactant.

Examples of the dispersion medium used for the resin particle dispersion include an aqueous medium.

Examples of the aqueous medium include water, such as distilled water and ion exchanged water, and alcohols. One kind of these may be used alone and two or more kinds thereof may be used in combination.

Examples of the surfactant include an anionic surfactant such as sulfate ester salt type, sulfonate type, phosphoric acid ester type, and soap type; a cationic surfactant such as amine salt type and quaternary ammonium salt type; and a nonionic surfactant such as polyethylene glycol type, alkylphenol ethylene oxide adduct type, and polyol type. Among these, examples particularly include an anionic surfactant and a cationic surfactant. The nonionic surfactant may be used in combination with an anionic surfactant or a cationic surfactant.

One kind of surfactants may be used alone and two or more kinds thereof may be used in combination.

In the resin particle dispersion, examples of a method of dispersing the resin particles in the dispersion medium include a general dispersing method such as a rotary shearing homogenizer, a ball mill having a medium, a sand mill, and a Dynomill. In addition, according to the type of the resin particles, the resin particles may be dispersed in the dispersion medium by a phase inversion emulsification method. The phase inversion emulsification method is a method in which a resin to be dispersed is dissolved in a hydrophobic organic solvent in which the resin is soluble, a base is added to an organic continuous phase (O phase) to neutralize, and then an aqueous medium (W phase) is added thereto, whereby phase inversion is performed from W/O to O/W to disperse the resin in a form of particles in the aqueous medium.

A volume average particle diameter of the resin particles dispersed in the resin particle dispersion is, for example, preferably from 0.01 μm to 1 μm, more preferably from 0.08 μm to 0.8 μm, and still more preferably 0.1 μm to 0.6 μm.

The volume average particle diameter of the resin particles is measured using a particle size distribution obtained by measurement with a laser diffraction type particle size distribution measuring device (for example, LA-700 manufactured by HORIBA. Ltd). A cumulative distribution is drawn from a small particle diameter side of the volume with respect to the divided particle size range (channel), and a particle diameter at which a cumulative 50% is reached with respect to all the particles is determined as the volume average particle diameter D50v. The volume average particle diameters of the particles in other dispersions are also measured as the same manner.

A content of the resin particles contained in the resin particle dispersion is preferably from 5% by weight to 50% by weight, and more preferably from 10% by weight to 40% by weight.

In the same manner as in the preparation of the resin particle dispersion, for example, the colorant particle dispersion and the release agent particle dispersion are also prepared. That is, regarding the volume average particle diameter of the particles, the dispersion medium, the dispersion method, and the content of the particles in the resin particle dispersion, the same is applied to colorant particles dispersed in the colorant particle dispersion and release agent particles dispersed in the release agent particle dispersion.

<Aggregated Particle Forming Step>

Next, the resin particle dispersion, the colorant particle dispersion, and the release agent particle dispersion are mixed with each other. Then, in the mixed dispersion, the resin particles, the colorant particles, and the release agent particles are hetero-aggregated to form the aggregated particles that have a diameter close to a diameter of a target toner particle and contain the resin particles, the colorant particles, and the release agent particles.

Specifically, for example, an aggregating agent is added to the mixed dispersion and the pH of the mixed dispersion is adjusted to be acidic (for example, pH of 2 to 5). A dispersion stabilizer is added, as needed. Thereafter, the mixed dispersion is heated to a temperature close to the glass transition temperature of the resin particles (specifically, for example, from glass transition temperature of resin particles −30° C. to glass transition temperature of resin particles −10° C.) to aggregate the particles dispersed in the mixed dispersion to form the aggregated particles.

In the aggregated particle forming step, for example, an aggregating agent is added at a room temperature (for example, 25° C.) while stirring the mixed dispersion with a rotary shearing homogenizer, the pH of the mixed dispersion is adjusted to acidic (for example, pH of 2 to 5), and the dispersion stabilizer is added as needed, thereafter, dispersion may be heated.

Examples of the aggregating agent include a surfactant having a polarity opposite to the polarity of the surfactant contained in the mixed dispersion, an inorganic metal salt, and a divalent or higher valent metal complex. In a case where the metal complex is used as the aggregating agent, the amount of the surfactant to be used is reduced and the charge characteristics are improved.

An additive forming a complex or analogous bonding with metal ions of the aggregating agent may optionally be used together with the aggregating agent. As the additive, a chelating agent is suitably used.

Examples of the inorganic metal salt include a metal salt such as calcium chloride, calcium nitrate, barium chloride, magnesium chloride, zinc chloride, aluminum chloride, and aluminum sulfate; and an inorganic metal salt polymer such as polyaluminum chloride, polyaluminum hydroxide, and calcium polysulfide.

As the chelating agent, a water-soluble chelating agent may be used. Examples of the chelating agent include oxycarboxylic acids such as tartaric acid, citric acid, and gluconic acid; aminocarboxylic acids such as iminodiacetic acid (IDA), nitrilotriacetic acid (NTA), and ethylenediaminetetraacetic acid (EDTA).

The amount of the aggregating agent to be added is preferably from 0.01 parts by weight to 5.0 parts by weight and more preferably 0.1 parts by weight or more and less than 3.0 parts by weight, with respect to 100 parts by weight of the resin particles.

<Coalescence Step>

Next, an aggregated particle dispersion in which the aggregated particles are dispersed is heated, for example, to be equal to or higher than the glass transition temperature of the resin particles (for example, higher than the glass transition temperature of the resin particles by 30° C. to 50° C.) and equal to or higher than the melting temperature of the release agent, thereby coalescing the aggregated particles to form toner particles.

In the coalescence step, at a temperature equal to or higher than the glass transition temperature of the resin particles and equal to or higher than the melting temperature of the release agent, the resin and release agent are in a state of being melted. Thereafter, the toner is obtained by cooling. As a method of adjusting the aspect ratio of the release agent in the toner, the aspect ratio may be adjusted by carrying out crystal growth by kept for a certain time at ambient temperature around the solidifying point of the release agent during cooling, or promoting crystal growth using two or more kinds of the release agents having different melting temperatures during cooling.

Through the above steps, toner particles are obtained.

After the aggregated particle dispersion in which the aggregated particles are dispersed is obtained, the toner particles may be produced through a step of forming second aggregated particles by further mixing the aggregated particle dispersion and the resin particle dispersion in which the resin particles are dispersed and aggregating such that the resin particles are further attached to the surfaces of the aggregated particles, and a step of forming toner particles having a core-shell structure by heating a second aggregated particle dispersion in which the second aggregated particles are dispersed and coalescing the second aggregated particles.

After the coalescence step ends, the toner particles formed in the solution are subjected to a washing step, a solid-liquid separation step, and drying step which are known to obtain dried toner particles. In the washing step, from the viewpoint of electrification characteristic, displacement washing with ion exchanged water may be sufficiently carried out. In the solid-liquid separation step, from the viewpoint of productivity, suction filtration, pressure filtration, and the like may be carried out. In the drying step, from the viewpoint of productivity, freeze-drying, airflow drying, fluidized drying, vibration type fluidized drying, and the like may be carried out.

Then, the toner according to Embodiment X, is produced by adding an external additive to the obtained dried toner particles and mixing these. The mixing may be performed by, for example, a V-blender, a Henschel mixer, or a Loedige mixer. Further, coarse particles of toner may be removed using a vibration sieving machine, wind classifier, or the like, as needed.

<Electrostatic Charge Image Developer>

An electrostatic charge image developer according to Embodiment X contains at least the toner according to Embodiment X. The electrostatic charge image developer according to Embodiment X may be a single-component developer including only the toner according to Embodiment X, or may be a two-component developer in which the toner and a carrier are mixed.

The carrier is not particularly limited, and examples thereof include known carriers. Examples of the carrier include a coated carrier in which a surface of a core formed of magnetic particles is coated with a resin; a magnetic particle dispersed carrier in which magnetic particles are dispersed in a matrix resin; a resin impregnated carrier in which porous magnetic particles are impregnated with a resin. The magnetic particle dispersed carrier and resin impregnated carrier may be a carrier in which constituent particles of the carrier are core and a surface thereof is coated with a resin.

Examples of the magnetic particles include magnetic metals such as iron, nickel, and cobalt; and magnetic oxides such as ferrite and magnetite.

Examples of the resin for coating and the matrix resin include polyethylene, polypropylene, polystyrene, polyvinyl acetate, polyvinyl alcohol, polyvinyl butyral, poly vinyl chloride, polyvinyl ether, polyvinyl ketone, a vinyl chloride-vinyl acetate copolymer, a styrene-acrylic acid ester copolymer, a straight silicone resin containing an organosiloxane bond or a modified product thereof, a fluorine resin, polyester, polycarbonate, a phenol resin, and an epoxy resin. The resin for coating and the matrix resin may contain additives such as conductive particles. Examples of the conductive particles include particles of metals such as gold, silver, and copper, carbon black, titanium oxide, zinc oxide, tin oxide, barium sulfate, aluminum borate, potassium titanate, and the like.

Examples of a method of coating the surface of the core with a resin include a method of coating the surface with a coating layer-forming solution in which a resin for coating and various additives (being used as needed) are dissolved in an appropriate solvent. The solvent is not particularly limited, and may be selected in consideration of the type of a resin to be used, coating suitability, or the like. Specific examples of a resin coating method include an immersion method in which core is immersed in a coating layer-forming solution; a spraying method in which a coating layer-forming solution is sprayed onto the core surface; a fluid bed method in which the coating layer-forming solution is sprayed in a state where the core is suspended by the flowing air; and a kneader coater method in which the core of a carrier and the coating layer-forming solution are mixed in a kneader coater and then the solvent is removed.

The mixing ratio (weight ratio) of the toner and the carrier in the two-component developer (Toner:Carrier) is preferably 1:100 to 30:100, and more preferably 3:100 to 20:100.

<Image Forming Apparatus and Image Forming Method>

Hereinafter, an image forming apparatus and an image forming method according to Embodiment X will be described.

An image forming apparatus according to Embodiment X includes: an image holding member, a charging unit that charges a surface of the image holding member, an electrostatic charge image forming unit that forms an electrostatic charge image on the charged surface of the image holding member, a developing unit that contains the electrostatic charge image developer, and develops an electrostatic charge image formed on a surface of the image holding member as a toner image by the electrostatic charge image developer, a transferring unit that transfers the toner image formed on a surface of the image holding member on a surface of a recording medium, and a fixing unit that fixes the toner image transferred on the surface of the recording medium. Then, as the electrostatic charge image developer, the electrostatic charge image developer according to Embodiment X is applied.

In an image forming apparatus according to Embodiment X, an image forming method (the image forming method according to Embodiment X) is carried out. The image forming method includes: charging a surface of an image holding member, forming an electrostatic charge image on a surface of the image holding member, and developing the electrostatic charge image formed on the surface of the image holding member as a toner image by the electrostatic charge image developer according to Embodiment X, transferring the toner image formed on the surface of the image holding member to a surface of a recording medium, and fixing the toner image transferred on the surface of the recording medium.

In the image forming apparatus according to Embodiment X, known image forming apparatuses are applied. Examples of the known image forming apparatus include a direct transfer type apparatus in which a toner image formed on a surface of an image holding member is directly transferred to a recording medium; an intermediate transfer type apparatus in which a toner image formed on a surface of an image holding member is primarily transferred to a surface of an intermediate transfer member and the toner image transferred to the surface of the intermediate transfer member is secondarily transferred to the surface of a recording medium; an apparatus including a cleaning unit that cleans a surface of an image holding member before being charged, after the transfer of the toner image, and an apparatus including an erasing unit that irradiates with static electricity the surface of an image holding member before charging, after the transfer of the toner image.

In a case where the image forming apparatus according to Embodiment X is the intermediate transfer type apparatus, a transfer unit adopts, for example, a configuration including an intermediate transfer member in which a toner image is transferred to a surface thereof, and a primary transfer unit that primarily transfers the toner image formed on a surface of an image holding member to a surface of the intermediate transfer member, and a secondary transfer unit that secondarily transfers the toner image transferred to the surface of the intermediate transfer member to the surface of a recording medium.

In the image forming apparatus according to Embodiment X, for example, a part including the developing unit may have a cartridge structure (a process cartridge) detachable from the image forming apparatus. As the process cartridge, a process cartridge including a developing unit contains the electrostatic charge image developer according to Embodiment X is suitably used.

Hereinafter, an example of the image forming apparatus according to Embodiment X will be described, but is not limited thereto. In the following description, the main part shown in the figure will be described, and the description of the other parts will be omitted.

FIG. 1 is a configuration diagram illustrating the image forming apparatus according to Embodiment X.

The image forming apparatus shown in FIG. 1 includes first to fourth image forming units 10Y, 10M, 10C, and 10K (image forming units) which are electrophotographic types and output images of respective colors of yellow (Y), magenta (M), cyan (C), and black (K) based on color separated image data. These image forming units (hereinafter simply referred to as "units") 10Y, 10M, 10C, and 10K are arranged side by side at predetermined distances apart from each other. These units 10Y, 10M, 10C and 10K may be process cartridges which are detachable from the image forming apparatus.

An intermediate transfer belt (an example of the intermediate transfer member) 20 extends above each of the units 10Y, 10M, 10C, and 10K through each unit. The intermediate transfer belt 20 is wound around a drive roll 22 and a support roll 24, which contact the inner surface of the intermediate transfer belt 20, and runs in a direction from the first unit 10Y to the fourth unit 10K. A force is applied to the support roll 24 in a direction away from the drive roll 22 by a spring or the like (not shown), and tension is applied to the intermediate transfer belt 20 wound around both the support roll 24 and the intermediate transfer belt 20. On an image holding surface side of the intermediate transfer belt 20, an intermediate transfer belt cleaning device 30 is provided so as to face the drive roll 22.

Yellow, magenta, cyan, and black toners contained in toner cartridges 8Y, 8M, 8C, and 8K are respectively supplied to the developing devices (an example of the developing units) 4Y, 4M, 4C, and 4K of the respective units 10Y, 10M, 10C, and 10K.

Since the first to fourth units 10Y, 10M, 10C, and 10K have the same configuration and operation, here, the first unit 10Y that forms a yellow image and disposed on an upstream side in a running direction of the intermediate transfer belt will be described as a representative.

The first unit 10Y includes a photoreceptor 1Y as an image holding member. Around the photoreceptor 1Y, a charging roll (an example of a charging unit) 2Y that charges a surface of the photoreceptor 1Y to have predetermined potential, an exposure device (an example of the electrostatic charge image forming unit) 3 that forms an electrostatic charge image by exposing the charged surface with a laser beam 3Y based on a color separated image signal, a developing device (an example of the developing unit) 4Y that supplies the charged toner to an electrostatic charge image to develop the electrostatic charge image, a primary transfer roll (an example of the primary transfer unit) 5Y that transfers a developed toner image onto the intermediate transfer belt 20, and a photoreceptor cleaning device (an example of the image holding member cleaning unit) 6Y that removes toner remaining on a surface of the photoreceptor 1Y after the primary transfer are arranged in order.

The primary transfer roll 5Y is disposed inside the intermediate transfer belt 20 and is provided at a position facing the photoreceptor 1Y. Bias power supplies (not shown) that apply a primary transfer bias are respectively connected to the primary transfer rolls 5Y, 5M, 5C, and 5K of the respective units. Each bias power supply changes a value of the transfer bias to be applied to each primary transfer roll by control of a control unit (not shown).

Hereinafter, an operation of forming a yellow image in the first unit 10Y will be described.

First, prior to the operation, the surface of the photoreceptor 1Y is charged to have a potential from −600 V to −800 V by the charging roll 2Y The photoreceptor 1Y is formed by laminating a photosensitive layer on a substrate having conductivity (for example, volume resistivity at 20° C. of $1\times10^{-6}$ 2 cm or less). The photosensitive layer has a property that the photosensitive layer is usually high resistance (general resistance of a resin) but when the photosensitive layer is irradiated with a laser beam, the resistivity of a portion irradiated with the laser beam changes. Therefore, the charged surface of the photoreceptor 1Y is irradiated with the laser beam 3Y from the exposure device 3 according to image data for yellow sent from the control unit (not shown). Accordingly, an electrostatic charge image having a yellow image pattern is formed on the surface of the photoreceptor 1Y.

The electrostatic charge image is an image formed on the surface of the photoreceptor 1Y by charging, and is a so-called negative latent image formed as follows. The resistivity of the irradiated portion of the photosensitive layer is lowered by the laser beam 3Y and electrification charge on the surface of the photoreceptor 1Y flows but electrification charge of the portion not irradiated with the laser beam 3Y remains.

The electrostatic charge image formed on the photoreceptor 1Y goes around to a predetermined development position as the photoreceptor 1Y runs. Then, at the development position, the electrostatic charge image on the photoreceptor 1Y is developed and visualized as a toner image by the developing device 4Y.

For example, an electrostatic charge image developer including at least a yellow toner and a carrier is contained inside the developing device 4Y The yellow toner is frictionally charged by being agitated inside the developing device 4Y, has the same polarity (negative polarity) charge as the electrification charge on the photoreceptor 1Y, and is held on a developer roll (an example of the developer holding member). Then, as the surface of the photoreceptor 1Y passes through the developing device 4Y, the yellow toner electrostatically adheres to the erased latent image portion on the surface of the photoreceptor 1Y, and the latent image is developed with the yellow toner. The photoreceptor 1Y on which the yellow toner image is formed is subsequently moved at a predetermined speed and the toner image developed on the photoreceptor 1Y is conveyed to a predetermined primary transfer position.

When the yellow toner image on the photoreceptor 1Y is conveyed to the primary transfer position, a primary transfer bias is applied to the primary transfer roll 5Y. An electrostatic force directed from the photoreceptor 1Y toward the primary transfer roll 5Y acts on the toner image and the toner image on the photoreceptor 1Y is transferred onto the intermediate transfer belt 20. The transfer bias applied at this time has a polarity (+) opposite to the polarity (−) of the toner and is controlled to, for example, +10 ρA by the control unit (not shown) in the first unit 10Y The toner remaining on the photoreceptor 1Y is removed by the photoreceptor cleaning device 6Y and collected.

The primary transfer bias applied to the primary transfer rolls 5M, 5C, and 5K after the second unit 10M is also controlled in accordance with the first unit.

In this manner, the intermediate transfer belt 20 to which the yellow toner image is transferred in the first unit 10Y is sequentially conveyed through the second to fourth units 10M, 10C, and 10K, toner images of respective colors are superimposed and multiply transferred.

The intermediate transfer belt 20, on which the four color toner images are multiply transferred through the first to fourth units, reaches a secondary transfer portion configured of the intermediate transfer belt 20, the support roll 24 contacting the inner surface of the intermediate transfer belt, and a secondary transfer roll (an example of the secondary transfer unit) 26 disposed on an image holding surface side of the intermediate transfer belt 20. On the other hand, a recording sheet (an example of the recording medium) P is supplied to a gap at which the secondary transfer roll 26 and the intermediate transfer belt 20 contact to each other via the supply mechanism at a predetermined timing, and the secondary transfer bias is supplied to the support roll 24. At this time, the applied transfer bias has the same polarity (−) as the polarity (−) of the toner, and an electrostatic force from the intermediate transfer belt 20 toward the recording sheet P acts on the toner image. The toner image on the intermediate transfer belt 20 is transferred onto the recording sheet P. At this time, the secondary transfer bias is determined according to the resistance detected by the resistance detecting unit (not shown) that detects the resistance of the secondary transfer portion, and a voltage is controlled.

The recording sheet P to which the toner image is transferred is sent to a nip portion (nip part) of a pair of fixing rollers in a fixing device (an example of the fixing unit) 28, and a toner image is fixed onto the recording sheet P to form a fixed image. The recording sheet P on which the fixing of the color image is completed is carried out toward a discharging unit, and a series of color image forming operations ends.

Examples of the recording sheet P to which the toner image is transferred include plain paper used in electrophotographic copying machines, printers and the like. Examples of the recording medium also include an OHP sheet, in addition to the recording sheet P. In order to further improve the smoothness of the image surface after fixing, the surface of the recording sheet P is also preferably smooth. For example, coated paper that is obtained by coating a surface of the plain paper with a resin or the like, art paper for printing, and the like are suitably used.

<Process Cartridge and Toner Cartridge>

A process cartridge according to Embodiment X is a process cartridge that is detachable from the image forming apparatus, the process cartridge including a developing unit that contains the electrostatic charge image developer according to Embodiment X, and develops the electrostatic charge image formed on a surface of an image holding member as a toner image by the electrostatic charge image developer.

The process cartridge according to Embodiment X may be configured to include a developing unit and, as needed, at least one selected from other units such as an image holding member, a charging unit, an electrostatic charge image forming unit, and a transfer unit.

Hereinafter, an example of the process cartridge according to Embodiment X will be described, but is not limited thereto. In the following description, the main part shown in the figure will be described, and the description of the other parts will be omitted.

Figure 2:
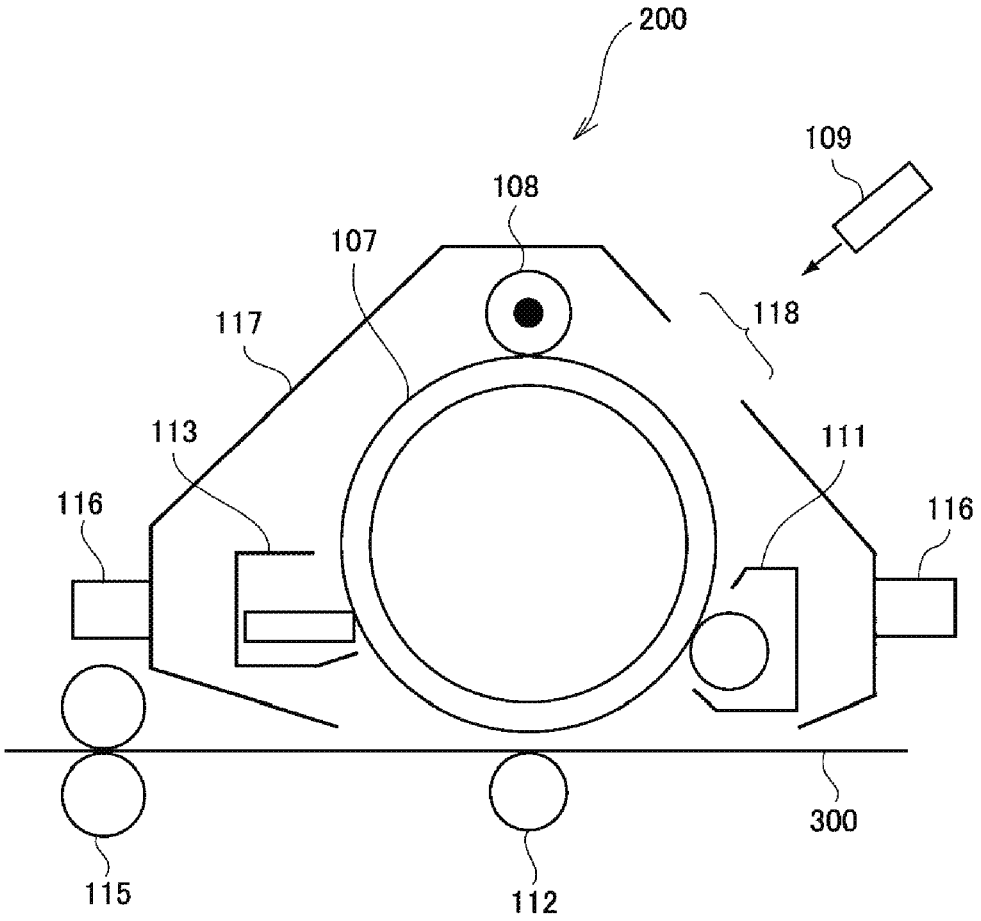
FIG. 2 is a configuration diagram illustrating a process cartridge according to the present exemplary embodiment.

FIG. 2 is a configuration diagram illustrating an example of the process cartridge according to Embodiment X.

A process cartridge 200 shown in FIG. 2 is configured, for example, as follows. A housing 117 including a mounting rail 116 and an opening 118 for exposure integrally holds a photoreceptor 107 (an example of the image holding member), a charging roll 108 (an example of a charging unit) provided around the photoreceptor 107, a developing device 111 (an example of the developing unit), and a photoreceptor cleaning unit 113 (an example of the cleaning unit) to form a cartridge.

In FIG. 2, reference numeral 109 denotes an exposure device (an example of the electrostatic charge image forming unit), reference numeral 112 denotes a transfer device (an example of the transfer unit), reference numeral 115 denotes a fixing device (an example of the fixing unit), and reference numeral 300 denotes a recording sheet (an example of the recording medium).

Hereinafter, the toner cartridge according to Embodiment X will be described.

A toner cartridge according to Embodiment X is a toner cartridge that contains the toner according to Embodiment X and is detachable from an image forming apparatus. The toner cartridge includes a container that contains a replenishment toner to be supplied to the developing unit provided in the image forming apparatus.

The image forming apparatus shown in FIG. 1 is an image forming apparatus having a configuration to which toner cartridges 8Y, 8M, 8C, and 8K are detachably attached. The developing devices 4Y, 4M, 4C, and 4K are respectively connected to toner cartridges corresponding to respective colors with toner supply tubes (not shown). In a case where an amount of the toner contained in the toner cartridge decreases, the toner cartridge is exchanged.

Hereinafter, Embodiment A according to the second aspect will be described.

<Electrostatic Charge Image Developing Toner>

In an electrostatic charge image developing toner according to Embodiment A, a surface property index value represented by Formula S is more than 2.8 and 3.5 or less.

(Surface property index value)=(Measured value of specific surface area)/(Calculated value of specific surface area) Formula S (Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}

In a toner of the related art, since the irregularities on the toner surface are small and the exposure of the toner particle surface is reduced, when the halftone image is output after the fixing temperature of the fixing unit is lowered by continuous output, the adhesion between the toners is insufficient, and there is a disadvantage that the rub resistance of the image is low.

In addition, as a method of confirming the surface properties of an electrostatic charge image developing toner, a method of measuring and calculating a specific surface area and the like by Coulter counter is known, but a method using flow particle image analysis (FPIA) is more excellent.

In the electrostatic charge image developing toner according Embodiment A, the rub resistance of the image is excellent by the configurations. The reason for this is not certain but is presumed as shown below.

When the surface property index value of the toner is more than 2.8 and 3.5 or less, the toner surface has many irregularities. Therefore, the external additive easily moves to the recessed portion. It is considered that the exposure of the toner surface is considerably large, and the adhesion between the toners is increased at the time of fixing. Therefore, even in a case where a solid image is continuously output under low temperature and low humidity and the temperature of the fixing unit is lowered, adhesion between toners is excellent. Accordingly, it is presumed that particularly when a halftone image with low image density is output, the electrostatic charge image developing toner having excellent rub resistance of the image is obtained.

Hereinafter, the electrostatic charge image developing toner according to Embodiment A will be described in detail.

In the electrostatic charge image developing toner according to Embodiment A, the surface property index value represented by Formula S is preferably from 2.85 to 3.45, more preferably from 2.95 to 3.20, and particularly preferably from 3.00 to 3.20, from the viewpoint of rub resistance of the image.

As a method of controlling the surface property index value, for example, when coalescing aggregated particles containing resin particles, the surface property index may be controlled by appropriately adjusting a temperature, pH, or the like.

In the electrostatic charge image developing toner according to Embodiment A, the calculated value of a specific surface area is preferably from 0.65 to 0.95, more preferably from 0.70 to 0.90, and particularly preferably from 0.75 to 0.85, from the viewpoint of rub resistance of an image.

With respect to the electrostatic charge image developing toner according to Embodiment A, a content of calcium atoms in the toner as measured by fluorescent X-ray analysis is preferably from 0.005 kcps to 0.35 kcps, more preferably from 0.01 kcps to 0.30 kcps, still more preferably from 0.03 kcps to 0.15 kcps, and particularly preferably from 0.05 kcps to 0.10 kcps, from the viewpoint of rub resistance of an image.

In a method of measuring the content of the calcium atoms in the toner as measured by the fluorescent X-ray analysis according to Embodiment A, a net intensity of a calcium atom content in the toners is measured with respect to the toner by using a fluorescent X-ray analyzer (XRF-1500, manufactured by Shimadzu Corporation). As a sample pretreatment, 0.13 g of toner is press-formed to have a disc-shape, and then measurement is performed under conditions of a tube voltage of 40 kV, a tube current of 90 mA, a measurement area of 10 mm(p, and a measurement time of 30 minutes, by a qualitative quantitative measurement.

The content of calcium atoms in the toner is adjusted, for example, by using a calcium aggregating agent used for preparing the toner.

In the electrostatic charge image developing toner according to Embodiment A, a half drop temperature by the flow tester is preferably from 110° C. to 150° C., more preferably from 120° C. to 140° C., and particularly preferably from 125° C. to 135° C., from the viewpoint of rub resistance of an image.

In a method of measuring the half drop temperature of the toner as measured by the flow tester in Embodiment A, a viscosity at a temperature corresponding to ½ of a height of an end point from a flow start point when a 1 $cm^3$ sample is melted and flowed out is obtained using a Koka type flow tester CFT-500 (manufactured by Shimadzu Corporation) under conditions that a pore diameter of a die is 1.0 mm, a pressure load is 10 $kgf/cm^2$, and a temperature rising rate is 7° C./min.

The descriptions of [Toner Particle] including the binder resin and the release agent regarding the toner according to Embodiment X described above are also applicable to the toner according to Embodiment A except for the followings.

The content of the binder resin is preferably from 40% by weight to 95% by weight, more preferably from 50% by weight to 90% by weight, and still more preferably from 60% by weight to 85% by weight, with respect to the whole toner particles.

In addition, the content of the binder resin in a case of using the white toner particles as toner particles is preferably from 30% by weight to 85% by weight with respect, and more preferably from 40% by weight to 60% by weight, with respect to the whole white toner particles.

A content of the release agent is preferably from 1% by weight to 20% by weight, and more preferably from 5% by weight to 15% by weight, with respect to the whole toner particles.

Descriptions of <Colorant>, <Other Additives>, and [External Additive] in Embodiment X are also applicable to Embodiment A.

Descriptions of [Preparing Method of Tone] in Embodiment X are also applicable to Embodiment A. However, <Aggregated Particle Forming Step> and <Coalescence Step> are as follows.

<Aggregated Particle Forming Step>

After the preparation step of the resin particle dispersion, the resin particle dispersion, the colorant particle dispersion, and the release agent particle dispersion are mixed with each other. Then, in the mixed dispersion, the resin particles, the colorant particles, and the release agent particles are hetero-aggregated to form the aggregated particles that have a diameter close to a diameter of a target toner particle and contains the resin particles, the colorant particles, and the release agent particles.

Specifically, for example, an aggregating agent is added to the mixed dispersion and the pH of the mixed dispersion is appropriately adjusted. A dispersion stabilizer is added, as needed. Thereafter, the mixed dispersion is heated to a temperature close to the glass transition temperature of the resin particles (specifically, for example, from glass transition temperature of resin particles −30° C. to glass transition temperature −10° C.) to aggregate the particles dispersed in the mixed dispersion to form the aggregated particles.

In the aggregated particle forming step, for example, an aggregating agent is added at a room temperature (for example, 25° C.) while stirring the mixed dispersion with a rotary shearing homogenizer, the pH of the mixed dispersion is adjusted, and the dispersion stabilizer is added as needed, thereafter, dispersion may be heated.

Examples of the aggregating agent include a surfactant having a polarity opposite to the polarity of the surfactant contained in the mixed dispersion, an inorganic metal salt, and a divalent or higher valent metal complex. In a case where the metal complex is used as the aggregating agent, the amount of the surfactant to be used is reduced and the charge characteristics are improved.

Among these, calcium salt compounds are preferable.

An additive forming a complex or analogous bonding with metal ions of the aggregating agent may optionally be used together with the aggregating agent. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

As the chelating agent, a water-soluble chelating agent may be used. Examples of the chelating agent include oxycarboxylic acids such as tartaric acid, citric acid, and gluconic acid; aminocarboxylic acids such as iminodiacetic acid (IDA), nitrilotriacetic acid (NTA), and ethylenediaminetetraacetic acid (EDTA).

<Coalescence Step>

After the aggregated particle forming step, an aggregated particle dispersion in which the aggregated particles are dispersed is heated, for example, to be equal to or higher than the glass transition temperature of the resin particles (for example, higher than the glass transition temperature of the resin particles by 10° C. to 30° C.), thereby coalescing the aggregated particles to form toner particles.

In the toner particles according to Embodiment A, since the surface property index value of the toner is more than 2.8 and 3.5 or less as described above, the toner surface has many irregularities, as compared with the toner particles of the related art. In order to obtain such a toner, for example, in the aggregated particle forming step, aggregating agents may be added plural times or the amount of the aggregating agent to be added may increase. In addition, in the coalescence step, a surfactant may be added.

Descriptions of <Electrostatic Charge Image developer>, <Image Forming Apparatus and Image Forming Method>, and <Process Cartridge and Toner Cartridge> in the above-described Embodiment X are also applicable to Embodiment A.

Hereinafter, Embodiment B according to the third aspect will be described.

<Electrostatic Charge Image Developing Toner>

In an electrostatic charge image developing toner according to Embodiment B, a surface property index value represented by Formula S is more than 1.0 and less than 2.0, and a calculated value of a specific surface area in Formula S is from 0.70 to 1.3.

(Surface property index value)=(Measured value of specific surface area)/(Calculated value of specific surface area) Formula S (Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}

In the toner of the related art, in a case where the toner surface has many irregularities and the charge distribution on the particle surface is likely to be uneven, and further, the external additive is used, the external additives are aggregated in the recessed portions when the external additive to the carrier is transferred, and the charge distribution on the particle surface is likely to be uneven. Therefore, variation in color difference due to toner scattering may occur in some cases.

In addition, as a method of confirming the surface properties of an electrostatic charge image developing toner, a method of measuring and calculating a specific surface area and the like by Coulter counter is known, but a method using flow particle image analysis (FPIA) is more excellent.

In the electrostatic charge image developing toner according to the Embodiment B, the rub resistance of the image is excellent by the configurations. The reason for this is not certain but is presumed as shown below.

The surface property index value of the toner is more than 1.0 and less than 2.0 and the calculated value of a specific surface area of the toner is from 0.70 to 1.3, so that the surface irregularity is appropriately finer than the usual toner. Therefore, the distribution of the charge amount is appropriately narrowed. In addition, particularly in the case of using the external additive, during flaking of the external additive, bias of the external additive on the toner surface is difficult to occur and the distribution of the charge amount is appropriately narrowed. For this reason, it is presumed that the electrostatic charge image developing toner which prevents color difference of an obtained image from varying.

In addition, for example, the influence of the variation tends to appear in a condition that environmental difference is large such as a case in which environment is changed from high temperature and high humidity to a low temperature and low humidity and further changed again to high temperature and high humidity environment. Specifically, an image density difference is likely to occur in a halftone image. On the contrary, the electrostatic charge image developing toner according to the Embodiment B, even in the case of using the external additive, when the external additive is transferred from the toner surface to the carrier surface or when the external additive is transferred from the carrier surface to the toner surface, bias of the external additive on the toner surface is unlikely to occur. For this reason, it is considered that the distribution of the charge amount is prevented to a relatively narrow range and the variation in the density of the halftone image is prevented from occurring.

Hereinafter, the electrostatic charge image developing toner according to Embodiment B will be described in detail.

(Surface Property Index Value and Calculated Value of Specific Surface Area)

In an electrostatic charge image developing toner according to Embodiment B, a surface property index value represented by Formula S is more than 1.0 and less than 2.0, and a calculated value of a specific surface area in Formula S is from 0.70 to 1.3.

(Surface property index value)=(Measured value of specific surface area)/(Calculated value of specific surface area) Formula S The measured value of a specific surface area of the toner in Embodiment B is a value measured by a nitrogen adsorption method. Specifically, the measured value of a specific surface area is measured by a one point method of the nitrogen adsorption method using a BET equation. An equilibrium relative pressure is set to 0.3.

The calculated value of a specific surface area of the toner in Embodiment B is calculated by the following formula.

(Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)}

The flow particle image analysis (FPIA) in calculation of the calculated value of a specific surface area is measured with a flow particle image analyzer (FPIA-3000 manufactured by Sysmex Corporation).

In this device, a method of measuring particles dispersed in water or the like by flow particle image analysis is adopted, and the aspirated particle suspension is guided to a flat sheath flow cell to form a flaky sample flow by a sheath liquid. The particles passing through are imaged as a still image with a charge coupled device (CCD) camera, through an objective lens, by irradiating the sample flow with strobe light. The captured particle image is subjected to a two-dimensional image processing to calculate the equivalent circle diameter from a projected area. Regarding the equivalent circle diameter, for each of 4,500 toner particles, image analysis is performed and statistical processing is performed to obtain the equivalent circle diameter. A sum of surface areas calculated from the equivalent circle diameters of 4,500 toner particles and a sum of volumes calculated from the equivalent circle diameter of 4,500 toner particles are obtained.

In the measurement by the flow particle image analysis, a HPF mode (high resolution mode) is used and a dilution magnification is set to 1.0 time.

In addition, in a method of measuring the specific gravity of the toner, the specific gravity is measured using a Gay-Lussac's type pycnometer with reference to 8.2.2 of JIS-K-0061.

In the electrostatic charge image developing toner according to Embodiment B, the surface property index value represented by Formula S is preferably from 1.20 to 1.80, more preferably from 1.30 to 1.70, and particularly preferably from 1.35 to 1.65, from the viewpoint of preventing color difference of an obtained image from varying.

In the electrostatic charge image developing toner according to Embodiment B, the calculated value of a specific surface area is preferably from 0.80 to 1.20, more preferably from 0.85 to 1.10, and particularly preferably from 0.90 to 1.00, from the viewpoint of preventing color difference of an obtained image from varying.

As a method of controlling the surface property index value and the calculated value of a specific surface area, for example, when coalescing aggregated particles containing resin particles, the surface property index may be controlled by appropriately adjusting a temperature, pH, or the like.

In addition, the surface property index value becomes small in a manner that a resin with a low molecular weight and a low acid value is used as a shell component of the toner, the coalescence temperature is lowered to coalesce for a long time, and after quenching, the surface is smoothed by acid annealing (adding acid and applying heat) or in a manner that silica particles from 120 nm to 250 nm are used as an external additive.

The toner according to Embodiment B includes toner particles (also referred to as "toner base particles") and, as needed, an external additive.

Among these, the toner according to Embodiment B preferably includes toner particles and an external additive.

In the toner according to Embodiment B, a ratio of a compacted bulk density after storage to a compacted bulk density before storage (Compacted bulk density after storage/Compacted bulk density before storage) is preferably from 0.90 to 0.99 and more preferably from 0.94 to 0.98, from the viewpoint of preventing color difference of an image from varying in the case where the toner is stored for a long period under high temperature and high humidity. Hereinafter, the "ratio of a compacted bulk density after storage to a compacted bulk density before storage" is also referred to as "change rate of compacted bulk density".

In Embodiment B, the compacted bulk density after storage means a compacted bulk density after storing the toner in the toner cartridge for 24 hours under high temperature and high humidity at 40° C. 50% RH (relative humidity). The compacted bulk density after storage is a value measured as follows. A lid to be attached is joined to a container (diameter 5 cm, height 5.2 cm, and capacity 100 $cm^3$). The container is filled with the toner to be measured, and impact is applied (tapping) to the bottom of the container 180 times. The lid at the end of the tapping is removed and the extra toner that is heaped up in the container is cut. The compacted bulk density ($g/cm^3$) is calculated from the amount of toner filled in the container.

The descriptions of [Toner Particle] (including the binder resin, the release agent, the colorant, and the other additives) and [External Additive] regarding the toner according to Embodiment X described above are applicable to the toner according to Embodiment B except for the followings.

As the binder resin, a styrene (meth)acrylic resin is preferable.

The styrene (meth)acrylic resin is a copolymer obtained by copolymerizing at least a monomer having a styrene skeleton and a monomer having a (meth)acrylic acid skeleton. The expression "(meth)acrylic acid" includes both acrylic acid and methacrylic acid.

Examples of the monomer having a styrene skeleton (referred to as "styrene monomer") include styrene, alkyl-substituted styrenes (such as α-methylstyrene, 2-methylstyrene, 3-methylstyrene, 4-methylstyrene, 2-ethylstyrene, 3-ethylstyrene, and 4-ethylstyrene), halogen-substituted styrenes (such as 2-chlorostyrene, 3-chlorostyrene, and 4-chlorostyrene), and vinylnaphthalene. One kind of styrene monomers may be used alone and two or more kinds thereof may be used in combination.

Among these, as the styrene monomers, the styrene is preferable from the viewpoints of ease of reaction, ease of reaction control, and availability.

Examples of the monomer having a (meth)acrylic acid skeleton (referred to as a "(meth)acrylic monomer") include (meth)acrylic acid and (meth)acrylic acid ester. Examples of the (meth)acrylic ester include (meth)acrylic acid alkyl ester (such as methyl (meth)acrylate, ethyl (meth)acrylate, n-propyl (meth)acrylate, n-butyl (meth)acrylate, n-pentyl (meth) acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, neopentyl (meth)acrylate, isohexyl (meth)acrylate, isoheptyl (meth) acrylate, isooctyl (meth)acrylate, 2-ethylhexyl (meth)acrylate, cyclohexyl (meth)acrylate, and t-butyl cyclohexyl (meth)acrylate), (meth)acrylic acid aryl ester (such as phenyl (meth)acrylate, biphenyl (meth)acrylate, diphenylethyl (meth)acrylate, t-butylphenyl (meth)acrylate, and terphenyl (meth)acrylate), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, and (meth)acrylamide. One kind of (meth)acrylic acid monomers may be used alone and two or more kinds thereof may be used in combination.

The copolymerization ratio (weight basis, styrene monomer/(meth)acrylic monomer) of the styrene monomers and (meth) acrylic monomers is, for example, preferably 90/10 to 70/30.

From the viewpoint of increasing the hardness of the toner particle surface, the styrene (meth)acrylic resin preferably has a crosslinked structure.

Examples of the styrene (meth)acrylic resin having the crosslinked structure include a crosslinked product obtained by copolymerizing at least the styrene monomer, (meth) acrylic acid monomer, and crosslinkable monomer to crosslink these.

Examples of the crosslinkable monomer include a bifunctional or higher functional crosslinking agent.

Examples of the bifunctional crosslinking agent include divinylbenzene, divinyl naphthalene, di(meth)acrylate compounds (such as diethylene glycol di(meth)acrylate, methylenebis (meth)acrylamide, decanediol diacrylate, and glycidyl (meth)acrylate), polyester di(meth)acrylate, and methacrylic acid 2-([1'-methylpropylideneamino]carboxyamino)ethyl.

Examples of the polyfunctional crosslinking agent include tri(meth)acrylate compounds (such as pentaerythritol tri(meth)acrylate, trimethylol ethane tri(meth)acrylate, and trimethylolpropane tri(meth)acrylate), tetra(meth)acrylate compounds (such as tetramethylolmethane tetra(meth) acrylate and oligoester (meth)acrylate), 2,2-bis(4-methacryloxy polyethoxyphenyl)propane, diallyl phthalate, triallyl cyanurate, triallyl isocyanurate, triallyl isocyanurate, triallyl trimellitate, and diallyl chlorendate.

The copolymerization ratio (weight basis, crosslinkable monomer/total monomer) of the crosslinkable monomers with respect to a total monomer is, for example, preferably from 2/1,000 to 30/1,000.

As a combination of the styrene monomer and the (meth) acrylic monomer, the following 1) combination is preferable, the following 2) combination is more preferable, and the following 3) combination is still more preferable.

1) a combination of at least one selected from styrene, alkyl-substituted styrene (such as α-methylstyrene, 2-methylstyrene, 3-methylstyrene, 4-methylstyrene, 2-ethylstyrene, 3-ethylstyrene, and 4-ethylstyrene) as the styrene monomer and at least one selected from butyl acrylate, methyl acrylate, and ethyl acrylate as (meth)acrylic monomer 2) a combination of at least one selected from styrene and alkyl-substituted styrene as the styrene monomer and at least one selected from butyl acrylate and ethyl acrylate as the (meth)acrylic monomer 3) a combination of styrene as the styrene monomer and butyl acrylate as the (meth)acrylic monomer The styrene (meth)acrylic resin may be synthesized by various polymerization methods such as solution polymerization, precipitation polymerization, suspension polymerization, bulk polymerization, and emulsion polymerization. The polymerization reaction may be carried out by a known operation such as a batch system, a semi-continuous system, and a continuous system.

Among the above polymerization methods, a solution polymerization method using a radical initiator is preferable. Examples of a solvent used in the solution polymerization method include various organic solvents such as ethyl acetate, butyl acetate, acetone, methyl ethyl ketone, methyl isobutyl ketone, cyclohexanone, tetrahydrofuran, dioxane, N,N-dimethylformamide, N,N-dimethylacetamide, benzene, toluene, acetonitrile, methylene chloride, chloroform, dichloroethane, methanol, ethanol, 1-propanol, 2-propanol, and 1-butanol. These organic solvents may be used alone or may be used in a mixture of two or more kinds thereof. These organic solvents may be used as a mixed solvent with water.

A polymerization temperature is set in relation to the molecular weight of the styrene (meth)acrylic resin to be produced, kinds of polymerization initiator, and the like. The polymerization temperature is preferably from 0° C. to 100° C. and more preferably from 50° C. to 100° C.

A reaction pressure is selectable, but is preferably from 1 $kgf/cm^2$ to 100 $kgf/cm^2$, and more preferably from 1 $kgf/cm^2$ to 30 $kgf/cm^2$. A reaction time is approximately from 5 hours to 30 hours. The obtained styrene (meth)acrylic resin may be purified by reprecipitation or the like.

The polymerization initiator is not limited.

Examples of the polymerization initiator include, as a water-soluble polymerization initiator, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxydicarbonate, tetralin hydroperoxide, 1-phenyl-2-methylpropyl-1-hydroperoxide, tert-butyl pertriphenyl acetate hydroperoxide, tert-butyl performate, tert-butyl peracetate, tert-butyl perbenzoate, tert-butyl perphenylacetate, tert-butyl permethoxyacetate, tert-butyl excess N-(3-toluyl) carbamate, ammonium bisulfate, and sodium bisulfate.

In addition, examples of the polymerization initiator include, as an oil-soluble polymerization initiator, azoic polymerization initiator such as 2,2'-azobisisobutyronitrile, 2,2'-azobis (2,4-dimethylvaleronitrile), 1,1'-azobis (cyclohexane-1-carbonitrile), and 2,2'-azobis-4-methoxy-2,4-dimethylvaleronitrile.

A weight average molecular weight (Mw) of the tetrahydrofuran (THF) soluble parts of the toner is preferably from 20,000 to 70,000, and more preferably from 30,000 to 60,000 from the viewpoint of preventing color difference of an obtained image from varying.

A number average molecular weight (Mn) of the tetrahydrofuran soluble parts of the toner is preferably from 500 to 100,000, and more preferably from 3,000 to 30,000 from the viewpoint of preventing color difference of an obtained image from varying.

A molecular weight distribution Mw/Mn of the tetrahydrofuran soluble parts of the toner is preferably from 1.5 to 100, and more preferably from 2 to 60.

In the tetrahydrofuran soluble parts of the toner, a peak in a molecular weight distribution curve and the weight average molecular weight are obtained with two of "HLC-8120 GPC, SC-8020 manufactured by Tosoh Corporation, 6.0 mmID×15 cm)" by using tetrahydrofuran (THF) as eluent and preparing the tetrahydrofuran soluble parts of the toner.

The tetrahydrofuran soluble parts of the toner is prepared by dissolving 0.5 mg of the toner sample in 1 g of tetrahydrofuran, and after applying ultrasonic dispersion, adjusting the concentration to be 0.5%.

An experiment is conducted using a RI detector under experimental conditions that sample concentration is 0.5%, a flow rate is 0.6 ml/min, a sample injection amount is 10 μl, and measurement temperature is 40° C.

In addition, the calibration curve is obtained from 10 samples of "Polystyrene standard sample TSK standard"

(manufactured by Tosoh Corporation): "A-500", "F-1", "F-10", "F-80", "F-380", "A-2500", "F-4", "F-40", "F-128", and "F-700".

The content of the binder resin is preferably from 40% by weight to 95% by weight, more preferably from 50% by weight to 90% by weight, and still more preferably from 60% by weight to 85% by weight, with respect to the whole toner particles.

Examples of the external additive include a resin particle (resin particles such as polystyrene, polymethyl methacrylate (PMMA), and melamine resin) and a cleaning aid (for example, metal salts of higher fatty acids represented by zinc stearate and particles of fluorinated polymer).

In addition, from the viewpoint of preventing color difference of an obtained image from varying, as the external additive, it is preferable to contain particles having a volume average particle diameter from 120 nm to 250 nm, and it is more preferable to contain silica particles having a volume average particle diameter from 120 nm to 250 nm. When particles having the volume average particle diameter from 120 nm to 250 nm is contained as the external additive, the aggregation of the external additives is prevented from occurring, the distribution of the charge amount of the toner is narrowed, and the color difference in the obtained image is prevented from varying.

Further, from the viewpoint of preventing color difference of an obtained image from varying, as the external additive, it is preferable to contain particles having a volume average particle diameter from 130 nm to 220 nm, and it is more preferable to contain particles having a volume average particle diameter from 140 nm to 200 nm.

The amount of external additive to be externally added is, for example, preferably from 0.01% by weight to 10% by weight and more preferably from 0.01% by weight to 6% by weight, with respect to the toner particles.

[Preparing Method of Toner]

Descriptions of [Preparing Method of Toner] in Embodiment X are also applicable to Embodiment B. However, <Coalescence Step> is as follows.

<Coalescence Step>

After the aggregated particle forming step, an aggregated particle dispersion in which the aggregated particles are dispersed is heated, for example, to be equal to or higher than the glass transition temperature of the resin particles (for example, higher than the glass transition temperature of the resin particles by 10° C. to 30° C.), thereby coalescing the aggregated particles to form toner particles.

Descriptions of <Electrostatic Charge Image developer>, <Image Forming Apparatus and Image Forming Method>, and <Process Cartridge and Toner Cartridge> in the above-described Embodiment X are also applicable to Embodiment B.

EXAMPLES

Hereinafter, Examples of Embodiment X according to the first aspect will be described, but the invention is not limited to the following Examples.

In the following description, unless otherwise specified, "%" and "part(s)" are on a weight basis.

In addition, the surface property index value of the toner, the measured value of a specific surface area, the calculated value of a specific surface area, the specific gravity of the toner, the melting temperature Tm of the release agent are measured or calculated by the above-described methods.

Example 1

—Preparation of Cyan Colored Particle Dispersion—

C.I. Pigment Blue 15:3:50 parts

Anionic surfactant (NEOGEN RK, manufactured by Dai-ichi Kogyo Seiyaku Co., Ltd.): 5 parts Ion exchanged water: 220 parts The above components are mixed and treated with an ultimizer (manufactured by Sugino Machine Co., Ltd.) at 240 MPa for 10 minutes to prepare a cyan colored particle dispersion (solid content concentration: 20%).

—Preparation of Release Agent Particle Dispersion (1) (Wax 1)—

Ester wax (WEP-2, manufactured by NOF CORPORATION): 100 parts

Anionic surfactant (NEOGEN RK, manufactured by Dai-ichi Kogyo Seiyaku Co., Ltd.): 2.5 parts Ion exchanged water: 250 parts The above materials are mixed, heated to 120° C., and dispersed using a homogenizer (ULTRA TURRAX T50, manufactured by IKA). Thereafter, the mixture is dispersed with a Manton-Gaulin high pressure homogenizer (manufactured by Gaulin Company) to obtain a release agent particle dispersion (1) in which the release agent particles having a volume average particle diameter of 330 nm are dispersed (wax 1, solid content 29.1%).

—Preparation of Release Agent Particle Dispersion (2) (Wax 2)—

Fischer Tropsch wax (HNP-9, manufactured by Nippon Seiro Co., Ltd.): 100 parts

Anionic surfactant (NEOGEN RK, manufactured by Dai-ichi Kogyo Seiyaku Co., Ltd.): 2.5 parts Ion exchanged water: 250 parts The above materials are mixed, heated to 120° C., and dispersed using a homogenizer (ULTRA TURRAX T50, manufactured by IKA). Thereafter, the mixture is dispersed with a Manton-Gaulin high pressure homogenizer (manufactured by Gaulin Company) to obtain a release agent particle dispersion (2) in which the release agent particles having a volume average particle diameter of 340 nm are dispersed (wax 2, solid content 29.2%).

—Preparation of Release Agent Particle Dispersion (3) (Wax 3)—

Paraffin wax (FNP 0090, manufactured by Nippon Seiro Co., Ltd.): 100 parts

Anionic surfactant (NEOGEN RK, manufactured by Dai-ichi Kogyo Seiyaku Co., Ltd.): 2.5 parts Ion exchanged water: 250 parts The above materials are mixed, heated to 120° C., and dispersed using a homogenizer (ULTRA TURRAX T50, manufactured by IKA). Thereafter, the mixture is dispersed with a Manton-Gaulin high pressure homogenizer (manufactured by Gaulin Company) to obtain a release agent particle dispersion (3) in which the release agent particles having a volume average particle diameter of 360 nm are dispersed (wax 3, solid content 29.0%).

—Preparation of Release Agent Particle Dispersion (4) (Wax 4)—

Polyethylene wax (Polywax 725 manufactured by Toyo Petrolite Co., Ltd.): 100 parts Anionic surfactant (NEOGEN RK, manufactured by Dai-ichi Kogyo Seiyaku Co., Ltd.): 2.5 parts Ion exchanged water: 250 parts The above materials are mixed, heated to 100° C., and dispersed using a homogenizer (ULTRA TURRAX T50, manufactured by IKA). Thereafter, the mixture is dispersed with a Manton-Gaulin high pressure homogenizer (manufactured by Gaulin Company) to obtain a release agent particle dispersion (4) in which the release agent particles having a volume average particle diameter of 370 nm are dispersed (wax 4, solid content 29.3%). —Preparation of Styrene Acrylic Resin Dispersion—

Styrene: 308 parts
n-Butyl acrylate: 100 parts
Acrylic acid: 2 parts
β-Carboxyethyl acrylate: 2 parts
Hexane thiol: 3 parts
Propanediol diacrylate: 1.5 parts The above components are mixed. The dissolved mixture is added to an aqueous solution prepared by dissolving 4 parts of an anionic surfactant (NEOGEN SC, manufactured by Dai-ichi Kogyo Seiyaku Co., Ltd.) in 550 parts of ion exchanged water and emulsified in a flask. Then, while mixing the solution for 10 minutes, an aqueous solution prepared by dissolving 6 parts of ammonium persulfate in 350 parts of ion exchanged water is added thereto and is subjected to purging with nitrogen. Then, while stirring the inside of the flask, contents are heated in an oil bath until the temperature reaches 75° C., and the emulsion polymerization is continued as it is for 5 hours. In this manner, a styrene acrylic resin dispersion (resin particle concentration: 42%) is obtained by dispersing the resin particles having an average particle diameter of 220 nm and a weight average molecular weight (Mw) of 40,500. The glass transition temperature of the amorphous styrene acrylic resin is 52° C. —Production of Cyan Toner Particles—

Ion exchanged water: 400 parts
Styrene acrylic resin particle dispersion: 200 parts
Cyan coloring agent particle dispersion: 40 parts
Release agent particle dispersion (2): 12 parts
Release agent particle dispersion (3): 24 parts The above components to be mixed are put into a stirring tank, and sufficiently mixed and dispersed with a homogenizer. Then, a liquid mixture of 2.1 parts of an aggregating agent (polyaluminum chloride, manufactured by Asada Chemical Industry Co., Ltd.) and 100 parts of ion exchanged water is added over 10 minutes while stirring the stirring tank at 300 rpm (rotation/min), and after completion of the addition, the liquid mixture is heated as it is to 49° C. at 1° C./min. After holding at 49° C. for 40 minutes, it is confirmed that aggregated particles having a volume average particle diameter of 4.8 μm are formed by measuring the particle diameter with Coulter-Multisizer II (manufactured by Beckman Coulter, Inc.).

115 parts of the resin particle dispersion is gently added to the dispersion containing the aggregated particles prepared as described above, and the temperature of the heating jacket is further increased and kept at 50° C. for 1 hour. The volume average particle size of the obtained adhered particles is measured to be 5.7 μm.

Next, a 1 mol/L sodium hydroxide aqueous solution is added such that the pH becomes to 5.5, and then the mixture is gently heated to 65° C. while stirring. Then, a 0.5 parts of the anionic surfactant (manufactured by Dai-ichi Kogyo Seiyaku Co., Ltd., NEOGEN RK) is added and the mixture is kept for 60 minutes. Thereafter, the solution is heated up to 91° C. and kept for 5 hours to perform coalescing. Thereafter, the obtained toner slurry is cooled to 85° C. and kept for 1 hour. Thereafter, the slurry is cooled to 25° C., and the slurry is sieved with a mesh opening of 30 μm to obtain cyan toner particles. —Production of Electrostatic Charge Image Developing Toner—

Cyan Toner Particles: 100 parts

Silica particles (trade name RY 50 manufactured by Nippon Aerosil Co., Ltd.): 0.8 parts The above composition is mixed for 15 minutes at a peripheral speed of 20 m/s by a Henschel mixer to obtain a toner of Example 1 (electrostatic charge image developing toner). —Production of Carrier—

Styrene methyl methacrylate copolymer: 5 parts (Weight ratio (Styrene/methyl methacrylate): 70/30)

Toluene: 15 parts

Carbon black (REGAL 330, manufactured by Cabot Corporation): 1 part

The above components are mixed and stirred for 10 minutes with a stirrer to prepare a coating layer-forming solution. Next, the resulting solution and 100 parts of ferrite particles (volume average particle diameter: 40 μm) are put in a vacuum degassing kneader and stirred at 60° C. for 30 minutes, followed by degassing and drying under reduced pressure while further heating, to thereby prepare a carrier. —Production of Electrostatic Charge Image Developer—

8 parts of the toner of Example 1 and 92 parts of the carrier are mixed by a V blender to prepare a developer (electrostatic charge image developer) of Example 1. In addition, each developer is obtained by changing the toner of Example 1 to each of the toners produced by the above toner production.

Examples 2 to 29 and Comparative Examples 1 and 2

Except that the kind and the addition amount of the release agent dispersion, the addition amount of polyaluminum chloride, adjusted pH, a coalescence temperature, a cooling temperature after coalescence, and keeping time are changed as shown in the following Table 1, toners and developers of Examples 2 to 29 and Comparative Examples 1 and 2 are produced respectively in the same manner as in Example 1.

TABLE 1

| | First kind of release agent dispersion | | Second kind of release agent dispersion | | Toner production condition | | | | |
|---|---|---|---|---|---|---|---|---|---|
| | Kind of release agent dispersion | (part) | Kind of release agent dispersion | (part) | Polyaluminum chloride (part) | Adjusted pH | Coalescence temperature (° C.) | Cooling temperature after coalescence (° C.) | Keeping time |
| Example 1 | wax2 | 12 | wax3 | 24 | 2.1 | 5.5 | 91 | 85 | 1 |
| Example 2 | wax2 | 12 | wax3 | 24 | 2.1 | 5.3 | 92 | 85 | 1 |
| Example 3 | wax2 | 12 | wax3 | 24 | 2.1 | 5.7 | 90 | 85 | 1 |

TABLE 1-continued

| | First kind of release agent dispersion | | Second kind of release agent dispersion | | Toner production condition | | | | |
|---|---|---|---|---|---|---|---|---|---|
| | Kind of release agent dispersion | (part) | Kind of release agent dispersion | (part) | Polyaluminum chloride (part) | Adjusted pH | Coalescence temperature (° C.) | Cooling temperature after coalescence (° C.) | Keeping time |
| Example 4 | wax2 | 12 | wax3 | 24 | 2.1 | 5.2 | 93 | 85 | 1 |
| Example 5 | wax2 | 12 | wax3 | 24 | 2.1 | 5.8 | 89 | 85 | 1 |
| Example 6 | wax2 | 12 | wax3 | 24 | 2.1 | 5.2 | 93 | 85 | 0.5 |
| Example 7 | wax2 | 12 | wax3 | 24 | 2.1 | 5.2 | 93 | 85 | 2 |
| Example 8 | wax2 | 12 | wax3 | 24 | 2.1 | 5.2 | 93 | 85 | 3 |
| Example 9 | wax2 | 12 | wax3 | 24 | 2.1 | 5.2 | 93 | 85 | 0.25 |
| Example 10 | wax2 | 12 | wax3 | 24 | 2.1 | 5.8 | 89 | 85 | 0.5 |
| Example 11 | wax2 | 12 | wax3 | 24 | 2.1 | 5.8 | 89 | 85 | 2 |
| Example 12 | wax2 | 12 | wax3 | 24 | 2.1 | 5.8 | 89 | 85 | 3 |
| Example 13 | wax2 | 12 | wax3 | 24 | 2.1 | 5.8 | 89 | 85 | 0.25 |
| Example 14 | wax1 | 12 | wax2 | 24 | 2.1 | 5.2 | 78 | 70 | 1 |
| Example 15 | wax3 | 12 | wax4 | 24 | 2.1 | 5.2 | 108 | 95 | 1 |
| Example 16 | wax3 | 7.2 | wax4 | 28.8 | 2.1 | 5.2 | 110 | 95 | 1 |
| Example 17 | wax1 | 28.8 | wax2 | 7.2 | 2.1 | 5.2 | 71 | 65 | 1 |
| Example 18 | wax1 | 12 | wax2 | 24 | 2.1 | 5.8 | 74 | 70 | 1 |
| Example 19 | wax3 | 12 | wax4 | 24 | 2.1 | 5.8 | 104 | 95 | 1 |
| Example 20 | wax3 | 7.2 | wax4 | 28.8 | 2.1 | 5.8 | 106 | 95 | 1 |
| Example 21 | wax1 | 28.8 | wax2 | 7.2 | 2.1 | 5.8 | 67 | 65 | 1 |
| Example 22 | wax2 | 12 | wax3 | 24 | 1.9 | 5.2 | 93 | 85 | 1 |
| Example 23 | wax2 | 12 | wax3 | 24 | 2.3 | 5.2 | 93 | 85 | 1 |
| Example 24 | wax2 | 12 | wax3 | 24 | 2.5 | 5.2 | 93 | 85 | 1 |
| Example 25 | wax2 | 12 | wax3 | 24 | 1.7 | 5.2 | 93 | 85 | 1 |
| Example 26 | wax2 | 12 | wax3 | 24 | 1.9 | 5.8 | 89 | 85 | 1 |
| Example 27 | wax2 | 12 | wax3 | 24 | 2.3 | 5.8 | 89 | 85 | 1 |
| Example 28 | wax2 | 12 | wax3 | 24 | 2.5 | 5.8 | 89 | 85 | 1 |
| Example 29 | wax2 | 12 | wax3 | 24 | 1.7 | 5.8 | 89 | 85 | 1 |
| Comparative Example 1 | wax2 | 12 | wax3 | 24 | 2.1 | 5.0 | 96 | 85 | 1 |
| Comparative Example 2 | wax2 | 12 | wax3 | 24 | 2.1 | 6.2 | 86 | 84 | 1 |

<Evaluation>

A developing unit of a commercially available electrophotographic copying machine (Docu Center Color 450, manufactured by Fuji Xerox Co., Ltd.) is filled with the obtained electrostatic charge image developer. After 10,000 sheets of images with area coverage 5% are output on the PREMIER 80 A4 WHITE PAPEER (manufactured by Xerox Corporation, basis weight of 80 g/m$^2$), Test Chart No. 5-2 of Imaging Society of Japan is output using Roston Color White (basis weight 256 gsm), an image defect in high TMA part (tertiary color) (evaluation of deletion degree) and gloss difference between a roll portion and a non-roll portion are evaluated. Regarding the gloss, 60° Gloss is measured three times using a Gloss meter (micro-TRI-Gloss: Gardner), and an average value thereof is obtained. Evaluation criteria are shown below. —Evaluation of Whitish Degree (Evaluation of Image Defect in High TMA Part (Tertiary Color))—

A: Deletion is not confirmed by visual observation or loupe observation.

B: Deletion may not be visually confirmed, but deletion is slightly confirmed by loupe observation.

C: Deletion is visually confirmed very slightly.

D: Deletion is confirmed, which is unacceptable level.

—Evaluation of Gloss Unevenness (Gloss Difference Evaluation Between Roll Portion and Non-Roll Portion)—

A: Gloss difference is less than 5.

B: Gloss difference is 5 or more and less than 10.

C: Gloss difference is 10 or more and less than 15.

D: Gloss difference is 15 or more.

The smaller the gloss difference, the less gloss unevenness. In addition, A, B and C are at practically acceptable levels.

TABLE 2

| | Release agent | | | | | Evaluation result | |
|---|---|---|---|---|---|---|---|
| | Surface property index | Aspect ratio number ratio | Aspect ratio area ratio | Melting temperature Tm (° C.) | Melt viscosity of toner (° C.) | Deletion | Gloss unevenness |
| Example 1 | 2.41 | 5.0 | 2.5 | 85 | 110 | A | A |
| Example 2 | 2.22 | 5.1 | 2.4 | 85 | 108 | A− | A |
| Example 3 | 2.61 | 4.9 | 2.6 | 85 | 110 | A | A− |
| Example 4 | 2.03 | 5.0 | 2.2 | 85 | 109 | B | A |

TABLE 2-continued

| | Surface property index | Release agent: Aspect ratio number ratio | Release agent: Aspect ratio area ratio | Melting temperature Tm (° C.) | Melt viscosity of toner (° C.) | Evaluation result: Deletion | Evaluation result: Gloss unevenness |
|---|---|---|---|---|---|---|---|
| Example 5 | 2.78 | 5.1 | 2.3 | 85 | 110 | A | B |
| Example 6 | 2.04 | 2.1 | 1.6 | 85 | 110 | B– | A |
| Example 7 | 2.03 | 6.8 | 3.4 | 85 | 108 | B | A– |
| Example 8 | 2.04 | 8.2 | 4.2 | 85 | 110 | A– | B |
| Example 9 | 2.05 | 0.95 | 0.96 | 85 | 108 | C | A |
| Example 10 | 2.74 | 2.2 | 1.7 | 85 | 110 | A– | B |
| Example 11 | 2.72 | 6.6 | 3.3 | 85 | 108 | A | B– |
| Example 12 | 2.73 | 8.4 | 4.3 | 85 | 108 | A | C |
| Example 13 | 2.75 | 0.94 | 0.97 | 85 | 109 | B | A– |
| Example 14 | 2.02 | 4.7 | 2.8 | 70 | 107 | B | A– |
| Example 15 | 2.03 | 5.1 | 2.4 | 100 | 108 | B– | A |
| Example 16 | 2.01 | 4.8 | 2.6 | 102 | 108 | C | A |
| Example 17 | 2.04 | 5.2 | 2.4 | 63 | 109 | A– | B |
| Example 18 | 2.77 | 5.0 | 2.6 | 70 | 106 | A | B– |
| Example 19 | 2.73 | 4.9 | 2.3 | 100 | 107 | A– | B |
| Example 20 | 2.71 | 5.1 | 2.4 | 102 | 110 | B | A– |
| Example 21 | 2.72 | 4.8 | 2.3 | 63 | 109 | A | C |
| Example 22 | 2.01 | 4.9 | 2.6 | 85 | 98 | B | A– |
| Example 23 | 2.03 | 5.1 | 2.4 | 85 | 128 | B– | A |
| Example 24 | 2.03 | 4.8 | 2.3 | 85 | 132 | C | A |
| Example 25 | 2.05 | 5.0 | 2.2 | 85 | 93 | A– | B |
| Example 26 | 2.77 | 4.8 | 2.4 | 85 | 97 | A | B– |
| Example 27 | 2.78 | 5.1 | 2.4 | 85 | 129 | A– | B |
| Example 28 | 2.75 | 4.9 | 2.3 | 85 | 131 | B | A– |
| Example 29 | 2.74 | 4.8 | 2.2 | 85 | 94 | A | C |
| Comparative Example 1 | 1.95 | 4.8 | 2.4 | 85 | 108 | D | A |
| Comparative Example 2 | 2.88 | 5.0 | 2.2 | 85 | 107 | A | D |

In Table 2, the surface property index is the surface property index value of the toner, represented by Formula S. The aspect ratio number ratio of the release agent is a value of a/b when the number of the release agents having an aspect ratio of 5 or more in the toner is taken as a and the number of the release agents having an aspect ratio of lower than 5 in the toner is taken as b. The aspect ratio area ratio is a value of c/d when an area of the release agents having an aspect ratio of 5 or more in a toner section is taken as c, and an area of the release agents having an aspect ratio of lower than 5 in the toner section is taken as d. The melt viscosity of the toner is the melt viscosity of the toner as measured by the flow tester method under a load of 10 $kgf/cm^2$. These are measured by the above-described methods.

In addition, "-" in the evaluation result of Table 2 indicates that it is slightly inferior to the appended evaluation criteria.

From the results shown in Table 2, it is found that in the electrostatic charge image developing toner of the exemplary embodiments, deletion and gloss unevenness of the obtained image are prevented from occurring, as compared with the electrostatic charge image developing toner of the comparative examples.

Hereinafter, Examples of Embodiment A will be described, but the invention is not limited to the following Examples. In the following description, unless otherwise specified, "%" and "part(s)" are on a weight basis.

In addition, the surface property index value of the toner, the measured value of a specific surface area, the calculated value of a specific surface area, the specific gravity of the toner, the half drop temperature of the toner as measured by a flow tester, and the content of calcium atoms in the toner are measured or calculated by the above-described methods.

Example 1A

—Preparation of Cyan Colored Particle Dispersion—

C.I. Pigment Blue 15:3:50 parts

Anionic surfactant (NEOGEN RK, manufactured by Dai-ichi Kogyo Seiyaku Co., Ltd.): 5 parts Ion exchanged water: 192.9 parts The above components are mixed and treated with an ultimizer (manufactured by Sugino Machine Co., Ltd.) at 240 MPa for 10 minutes to prepare a cyan colored particle dispersion (solid content concentration: 20%). —Preparation of Release Agent Particle Dispersion—

Paraffin wax (HNP-9, manufactured by Nippon Seiro Co., Ltd.): 60 parts

Anionic surfactant (NEOGEN RK, manufactured by Dai-ichi Kogyo Seiyaku Co., Ltd.): 2 parts Ion exchanged water: 140 parts The above materials are mixed, heated to 100° C., and dispersed using a homogenizer (ULTRA TURRAX T50, manufactured by IKA). Thereafter, the mixture is dispersed with a Manton-Gaulin high pressure homogenizer (manufactured by Gaulin Company) to obtain a release agent particle dispersion in which the release agent particles having a volume average particle diameter of 200 nm are dispersed (solid content 30%). —Preparation of Styrene Acrylic Resin Dispersion—

Styrene: 308 parts n-Butyl acrylate: 100 parts

Acrylic acid: 4 parts

Dodecanethiol: 3 parts

Propanediol diacrylate: 1.5 parts

The above components are mixed. The dissolved mixture is added to an aqueous solution prepared by dissolving 4 parts of an anionic surfactant (NEOGEN SC, manufactured by Dai-ichi Kogyo Seiyaku Co., Ltd.) in 550 parts of ion exchanged water and emulsified in a flask. Then, while mixing the solution for 10 minutes, an aqueous solution prepared by dissolving 6 parts of ammonium persulfate in 350 parts of ion exchanged water is added thereto and is subjected to purging with nitrogen. Then, while stirring the inside of the flask, contents are heated in an oil bath until the temperature reaches 75° C., and the emulsion polymerization is continued as it is for 5 hours. In this manner, a styrene acrylic resin dispersion (resin particle concentration: 40%) in which the resin particles having an average particle diameter of 195 nm and a weight average molecular weight (Mw) of 41,000 are dispersed. The glass transition temperature of the amorphous styrene acrylic resin is 52° C. —Production of Cyan Toner Particles—

Ion exchanged water: 400 parts

Styrene acrylic resin particle dispersion: 240 parts

Cyan coloring agent particle dispersion: 64 parts

Release agent particle dispersion: 56 parts

The above components to be mixed are put into a stirring tank, and sufficiently mixed and dispersed with a homogenizer. Then, an aqueous solution prepared by dissolving 12.0 parts of calcium chloride as an aggregating agent 1 in 50 parts of ion exchanged water is added over 10 minutes while stirring the stirring tank at 200 rpm (rotation/min), and after completion of the addition, the aqueous solution is heated as it is to 40° C. at 0.5° C./min, and the aqueous solution is kept for 30 minutes. Then, the aqueous solution is heated to 49° C. at 0.5° C./min. After holding at 49° C. for 40 minutes, it is confirmed that aggregated particles having a volume average particle diameter of 4.8 μm are formed by measuring the particle diameter with Coulter-Multisizer II (manufactured by Beckman Coulter, Inc.). Further, the temperature of the heating jacket is increased and kept at 52° C. for 40 minutes.

Further, an aqueous solution prepared by dissolving 4.0 parts of calcium chloride as an aggregating agent 2 in 20 parts of ion exchanged water is added to the dispersion containing the aggregated particles, prepared as described above. Then, 65 parts of the resin particle dispersion is gently added thereto. Further, the temperature of the heating jacket is further increased and kept at 53° C. for 1 hour. The volume average particle size of the obtained adhered particles is measured to be 5.7 μm.

Next, a 1 mol/L sodium hydroxide aqueous solution is added such that the pH becomes to 6.0, and then the mixture is gently heated to 85° C. while stirring. Then, a 0.5 parts of the anionic surfactant (manufactured by Dai-ichi Kogyo Seiyaku Co., Ltd., NEOGEN RK) is added thereto and the mixture is kept for 60 minutes. Thereafter, the solution is heated up to 96° C., 1 mol/L nitric acid aqueous solution is added thereto until the pH reaches 5.0, and the solution is kept for 5 hours. Thereafter, the obtained toner slurry is cooled to 40° C., and the slurry is sieved with a mesh opening of 30 μm to obtain a cyan toner. —Production of Electrostatic Charge Image Developing Toner—

Cyan Toner Particles: 100 parts

Silica particles (trade name RY 50 manufactured by Nippon Aerosil Co., Ltd.): 0.8 parts The above composition is mixed for 15 minutes at a peripheral speed of 20 m/s by a Henschel mixer to thereby obtain a toner of Example 1A (electrostatic charge image developing toner). —Production of Carrier—

Styrene methyl methacrylate copolymer: 5 parts (Weight ratio (Styrene/methyl methacrylate): 70/30, Mw: 80,000)

Toluene: 15 parts

Carbon black (REGAL 330, manufactured by Cabot Corporation): 1 part

The above components are mixed and stirred for 10 minutes with a stirrer to prepare a coating layer-forming solution. Next, the resulting solution and 100 parts of ferrite particles (volume average particle diameter: 40 μm) are placed in a vacuum degassing kneader and stirred at 60° C. for 30 minutes, followed by degassing and drying under reduced pressure while further heating, to thereby prepare a carrier. —Production of Electrostatic Charge Image Developer—

8 parts of the toner of Example 1A and 92 parts of the carrier are mixed by a V blender to prepare a developer (electrostatic charge image developer) of Example 1A. In addition, each developer is obtained by changing the toner (1A) to each of the toners produced by the above toner production.

Examples 2A to 11A and Comparative Example 2A

Except that the amounts of the aggregating agent 1, the aggregating agent 2, and the surfactant to be used are changed to the amounts shown in Table 3 below, toners and developers are prepared in the same manner as in Example 1A.

Example 12A

Except that the aggregating agent 1 and the aggregating agent 2 to be used are changed to PAC (PAC 100W manufactured by Asada Chemical Industry) and the amounts of the aggregating agent 1, the aggregating agent 2, and the surfactant are changed to the amounts shown in Table 3 below, toners and developers are produced in the same manner as in Example 1A.

Comparative Example 1A

—Production of Cyan Toner—

Ion exchanged water: 400 parts

Styrene acrylic resin particle dispersion: 240 parts

Cyan coloring agent particle dispersion: 64 parts

Release agent particle dispersion: 56 parts

The above components to be mixed are put into a stirring tank, and sufficiently mixed and dispersed with a homogenizer. Then, an aqueous solution prepared by dissolving 6.1 parts of calcium chloride as an aggregating agent in 50 parts of ion exchanged water is added thereto over 10 minutes while stirring the stirring tank at 200 rpm, and after completion of the addition, the aqueous solution is heated as it is to 40° C. at 0.5° C./min, and the aqueous solution is kept for 30 minutes. Then, the aqueous solution is heated to 49° C. at 0.5° C./min. After holding at 49° C. for 40 minutes, it is confirmed that aggregated particles having a volume average particle diameter of 4.8 μm are formed by measuring the particle diameter with Coulter-Multisizer II (manufactured by Beckman Coulter, Inc.). Further, the temperature of the heating jacket is increased and kept at 52° C. for 40 minutes.

65 parts of the resin particle dispersion is gently added to the dispersion containing the aggregated particles prepared as described above, and the temperature of the heating jacket is further increased and kept at 53° C. for 1 hour. The volume average particle size of the obtained adhered particles measured is 5.7 μm.

Next, a 1 mol/L sodium hydroxide aqueous solution is added such that the pH becomes to 6.0, and then the mixture is gently heated to 85° C. while stirring, and kept for 60 minutes. Thereafter, the solution is heated up to 96° C., 1 mol/L nitric acid aqueous solution is added thereto until the pH reaches 5.0, and the solution is kept for 5 hours. Thereafter, the obtained toner slurry is cooled to 40° C., and the slurry is sieved with a mesh opening of 30 μm to obtain cyan toner.

Except that the cyan toner obtained above is used, toners and developers are prepared in the same manner as in Example 1A.

<Evaluation of Rub Resistance>

A developing unit of a commercially available electrophotographic copying machine (Docu Center Color 450 (manufactured by Fuji Xerox Co., Ltd.)) is filled with the electrostatic charge image developer, and in a temperature of 15° C. and a humidity of 20% RH, 10,000 sheets of solid images having an image density of 100% are output on the PREMIER 80 A4 WHITE PAPEER (manufactured by Xerox Corporation, basis weight of 80 g/m$^2$). Immediately thereafter, test chart No. 5-2 of Imaging Society of Japan is output to OK Prince wood free paper (basis weight 127 g/m$^2$). An unused OK Prince wood free paper is placed on the image and, using a surface property tester TRIBOGEAR 14 DR (manufactured by Shinto Scientific Co., Ltd.), the surface of the fixed image is rubbed with the unused paper with a vertical load of 100 g at a rubbing speed of 10 mm/sec and rubbing with a reciprocating width of 2 cm and rubbing reciprocation number of 10 times. The stain of unused paper after rubbing is visually observed and observed with a 50 magnification loupe.

Evaluation criteria are as follows.

A: Stain due to toner is not confirmed.

B: Stain due to toner may not be visually confirmed, but slight stain is confirmed by loupe observation.

C: Stain due to toner is visually confirmed very slightly.

D: Stain due to toner is visually and remarkably confirmed.

In addition, the surface property index value of the toner, the measured value of a specific surface area, the calculated value of a specific surface area, the specific gravity of the toner, the weight average molecular weight of the THF soluble portion of the toner, and the value of the ratio of the compacted bulk density after storage to a compacted bulk density before storage (Compacted bulk density after storage/Compacted bulk density before storage) of the toner are measured or calculated by the above-described methods.

Example 1B —Preparation of Resin Particle Dispersion (1)—

Styrene (manufactured by Wako Pure Chemical Industries, Ltd.): 330 parts by weight n-Butyl acrylate (manufactured by Wako Pure Chemical Industries, Ltd): 60 parts by weight Dodecanethiol (manufactured by Wako Pure Chemical Industries, Ltd): 3.1 parts by weight The above components mixed and dissolved are emulsified and dispersed in a solution prepared by dissolving 6 parts by weight of a nonionic surfactant (NONIPOL 400, manufactured by Sanyo Chemical Industries, Ltd.) and 10 parts by weight of an anionic surfactant (NEOGEN SC, manufactured by Dai-ichi Kogyo Seiyaku Co., Ltd.) in 550 parts by weight of ion exchanged water in a flask. 50 parts by weight of ion exchanged water in which 4 parts by weight of ammonium persulfate is dissolved is added thereto while gently mixing for 10 minutes. Purging with nitrogen is performed. Then, while stirring the inside of the flask, contents are heated in an oil bath until the temperature reaches 70° C., and the emulsion polymerization is continued for 5 hours. As a result, a resin particle dispersion (1) in which styrene acrylic resin particles having a volume average particle diameter D50v=104 nm, a glass transition temperature Tg of 59° C., and a weight average molecular weight of 34,000 are dispersed is obtained. —Preparation of Resin Particle Dispersion (2)—

Styrene: 300 parts by weight n-Butyl acrylate: 90 parts by weight

Acrylic acid: 0.1 by weight

Dodecanethiol: 2.8 by weight

Methacrylic acid 2-(dimethylaminoester): 1.0 part by weight

TABLE 3

| | Amount of aggregating agent 1 (part)) | Amount of aggregating agent 2 (part)) | Amount of surfactant (part) | Calculated value of specific surface area | Surface property index value | Ca amount in toner (kcps) | Half drop temperature (° C.) | Rub resistance evaluation |
|---|---|---|---|---|---|---|---|---|
| Example 1A | 12.0 | 4.0 | 0.5 | 0.77 | 3.10 | 0.078 | 130 | A |
| Example 2A | 12.0 | 0.4 | 0.25 | 0.75 | 2.82 | 0.060 | 126 | C |
| Example 3A | 12.0 | 7.1 | 0.75 | 0.78 | 3.48 | 0.152 | 133 | C |
| Example 4A | 6.1 | 1.8 | 0.5 | 0.76 | 2.83 | 0.015 | 116 | C |
| Example 5A | 8.8 | 2.8 | 0.5 | 0.77 | 2.91 | 0.051 | 124 | B |
| Example 6A | 15.7 | 4.0 | 0.5 | 0.78 | 3.04 | 0.148 | 137 | B |
| Example 7A | 19.8 | 5.4 | 0.5 | 0.79 | 3.45 | 0.287 | 145 | C |
| Example 8A | 6.1 | 1.8 | 0.2 | 0.71 | 2.81 | 0.013 | 111 | C |
| Example 9A | 8.8 | 2.8 | 0.3 | 0.74 | 2.86 | 0.049 | 121 | B |
| Example 10A | 15.7 | 4.0 | 0.8 | 0.78 | 3.35 | 0.157 | 138 | B |
| Example 11A | 19.8 | 5.4 | 0.12 | 0.83 | 3.48 | 0.28 | 149 | C |
| Example 12A | 1.5 | 0.3 | 0.5 | 0.77 | 3.10 | 0 | 130 | A |
| Comparative Example 1A | 6.1 | 0 | 0 | 0.78 | 2.60 | 0.008 | 109 | D |
| Comparative Example 2A | 19.8 | 7.1 | 0.75 | 0.77 | 3.60 | 0.31 | 152 | D |

From the results shown in Table 3, it is found that in the electrostatic charge image developing toner of the exemplary embodiments, the rub resistance of an obtained image is excellent, as compared with the electrostatic charge image developing toner of the comparative examples.

Hereinafter, Examples of Embodiment B will be described, but the invention is not limited to the following Examples. In the following description, unless otherwise specified, "%" and "part(s)" are on a weight basis.

The above components mixed and dissolved are emulsified and dispersed in a solution prepared by dissolving 6 parts by weight of a nonionic surfactant (NONIPOL 400, manufactured by Sanyo Chemical Industries, Ltd.) and 10 parts by weight of an anionic surfactant (NEOGEN SC, manufactured by Dai-ichi Kogyo Seiyaku Co., Ltd.) in 550 parts by weight of ion exchanged water in a flask. 50 parts by weight of ion exchanged water in which 4 parts by weight of ammonium persulfate is dissolved is added thereto while gently mixing for 10 minutes. Purging with nitrogen is performed. Then, while stirring the inside of the flask, contents are heated in an oil bath until the temperature reaches 70° C., and the emulsion polymerization is continued for 5 hours. As a result, a resin particle dispersion (2) in which resin particles having a volume average particle diameter D50v=120 nm, a glass transition temperature Tg of 52° C., and a weight average molecular weight of 35,000 are dispersed is obtained. —Preparation of Release Agent Particle Dispersion—

Paraffin wax (HNP-9, manufactured by Nippon Seiro Co., Ltd.): 100 parts

Anionic surfactant (NEOGEN RK, manufactured by Dai-ichi Kogyo Seiyaku Co., Ltd.): 1 part Ion exchanged water: 350 parts The above materials are mixed, heated to 100° C., and dispersed using a homogenizer (ULTRA TURRAX T50, manufactured by IKA). Thereafter, the mixture is dispersed with a Manton-Gaulin high pressure homogenizer (manufactured by Gaulin Company) to obtain a release agent particle dispersion in which the release agent particles having a volume average particle diameter of 200 nm are dispersed (solid content 20%). —Preparation of Magenta Colored Particle Dispersion—

C.I. Pigment Red 122: 50 parts

Anionic surfactant (NEOGEN RK, manufactured by Dai-ichi Kogyo Seiyaku Co., Ltd.): 5 parts Ion exchanged water: 192.9 parts The above components are mixed and treated with an ultimizer (manufactured by Sugino Machine Co., Ltd.) at 240 MPa for 10 minutes to prepare a magenta colored particle dispersion (solid content concentration: 20%). —Production of Hydrophobic Silica Particle (1)—

300 parts of methanol and 49.5 parts of 10% ammonia aqueous solution are put in a glass reaction vessel provided with a metal stirrer bar, a dropping nozzle (Teflon (registered trademark) microtube pump), and a thermometer, and then stirred and mixed to obtain an alkaline catalyst solution. Next, the temperature of the alkaline catalyst solution is adjusted to 25° C., and the alkaline catalyst solution is purged with nitrogen. Next, 450 parts of tetramethoxysilane (TMOS) and 270 parts of an ammonia aqueous solution having a catalyst (NH3) concentration of 4.44% are simultaneously dropped at the following supply rate while stirring the alkaline catalyst solution to obtain a silica particle suspension. Here, the supply rate of TMOS is set to 3.3 parts/min and the supply rate of 4.44% ammonia aqueous solution is set to 1.98 parts/min.

Next, the obtained silica particle suspension is dried by spray drying to remove the solvent to obtain a powder of hydrophilic silica particles. 100 parts of the obtained hydrophilic silica particle powder is put in a mixer and stirred at 200 rpm while heating in a nitrogen atmosphere at 200° C., and 30 parts of hexamethyldisilazane is added dropwise to the hydrophilic silica particle powder and reacted for 2 hours. Next, the mixture is cooled to obtain hydrophobic silica particles (1). When the volume average particle diameter of the hydrophobic silica particles (1) is measured in a state where the hydrophobic silica particles (1) are externally added to the toner particles, the volume average particle diameter of the hydrophobic silica particles (1) is 154 nm. —Production of Hydrophobic Silica Particle (2)—

Except that the amount of 10% ammonia aqueous solution is changed to 51.7 parts, the supply rate of TMOS is changed to 4.4 parts/min, and the supply rate of 4.44% ammonia aqueous solution is changed to 2.55 parts/min, the hydrophobic silica particles (2) are obtained in the same manner in the production of the hydrophobic silica particles (1). When the volume average particle diameter of the hydrophobic silica particles (2) is measured in a state where the hydrophobic silica particles (2) are externally added to the toner particles, the volume average particle diameter of the hydrophobic silica particles (2) is 245 nm. —Production of Hydrophobic Silica Particle (3)—

Except that the amount of 10% ammonia aqueous solution is changed to 48.3 parts, the supply rate of TMOS is changed to 4.3 parts/min, and the supply rate of 4.44% ammonia aqueous solution is changed to 2.55 parts/min, the hydrophobic silica particles (3) are obtained in the same manner in the production of hydrophobic silica particles (1). When the volume average particle diameter of the hydrophobic silica particles (3) is measured in a state where the hydrophobic silica particles (3) is externally added to the toner particles, the volume average particle diameter of the hydrophobic silica particles (3) is 125 nm. —Production of Magenta Toner—

Resin particle dispersion (1): 402.5 parts

Magenta colored particle dispersion: 12.5 parts

Release agent particle dispersion: 50 parts

Anionic surfactant (TAYCA POWER, manufactured by Tayca Corporation): 2 parts

The above materials are put in a round stainless steel flask, and the pH is adjusted to 3.5 by adding 0.1 mol/L nitric acid. Then, 30 parts of a nitric acid aqueous solution having a polyaluminum chloride concentration of 10% is added. Next, the mixture is dispersed at 30° C. using a homogenizer (ULTRA TURRAX T50, manufactured by IKA Co., Ltd.), then heated to 45° C. in a heating oil bath, and kept until the volume average particle diameter reaches 5.2 μm. Thereafter, 100 parts of the resin particle dispersion (2) is added and kept for 1 hour, and a 0.1 mol/L sodium hydroxide aqueous solution is added to adjust the pH to 8.5. Then, the mixture is heated to 78° C. while stirring, and kept for 10 hours. Thereafter, the mixture is cooled to 30° C. at a rate of 20° C./min and 0.1 mol/L nitric acid is added to adjust the pH to 4.0, and then heated again to 60° C. in a heating oil bath and then kept for 3 hours. Thereafter, the mixture is cooled to 20° C. at a rate of 20° C./min, filtered, sufficiently washed with ion exchanged water, and dried to obtain toner particles (1) having a volume average particle diameter of 6.2 μm.

2.0 parts by weight of hydrophobic silica particles (1) and 1.0 part by weight of hydrophobic titanium oxide (T805 manufactured by Nippon Aerosil Co., Ltd.) are mixed and blended with 100 parts by weight of toner particles (1) using a sample mill at 10,000 rpm (rotation/min) for 30 seconds. Thereafter, by sieving with a vibration sieve having an opening of 45 μm, a toner externally added is produced. —Production of Carrier—

Styrene methyl methacrylate copolymer: 5 parts (Weight ratio (Styrene/methyl methacrylate): 70/30, Mw: 80,000)

Toluene: 15 parts

Carbon black (REGAL 330, manufactured by Cabot Corporation): 1 part

The above components are mixed and stirred for 10 minutes with a stirrer to prepare a coating layer-forming solution. Next, the resulting solution and 100 parts of ferrite particles (volume average particle diameter: 40 μm) are put in a vacuum degassing kneader and stirred at 60° C. for 30 minutes, followed by degassing and drying under reduced pressure while further heating, to thereby prepare a carrier.

—Production of Electrostatic Charge Image Developer—

8 parts of the toner of Example 1B and 92 parts of the carrier are mixed by a V blender to prepare a developer (electrostatic charge image developer) of Example 1B. In addition, each developer is obtained by changing the toner (1) to each of the toners produced by the above toner production.

Example 2B

Except that conditions of being heated to 78° C. and kept for 10 hours are changed to conditions of being heated to 76° C. and kept for 8 hours, and pH after being cooled to 30° C. is changed from 4.0 to 4.5, the toner and developer are produced in the same manner as in Example 1B.

Example 3B

Except that conditions of being heated to 78° C. and kept for 10 hours are changed to conditions of being heated to 79° C. and kept for 11 hours, and pH after being cooled to 30° C. is changed from 4.0 to 3.5, the toner and developer are produced in the same manner as in Example 1B.

Example 4B

Except that keeping until the volume average particle diameter reaches 5.2 μm is changed to keeping until the volume average particle diameter reaches 8.8 μm, the toner and developer are produced in the same manner as in Example 1B.

Example 5B

Except that keeping until the volume average particle diameter reaches 5.2 μm is changed to keeping until the volume average particle diameter reaches 3.0 μm, the toner and developer are produced in the same manner as in Example 2B.

Example 6B

Except that the addition amount of dodecanethiol in the preparation of the resin particle dispersion (1) is changed to 1.2 parts by weight, the toner and developer are produced in the same manner as in Example 1B.

Example 7B

Except that the addition amount of dodecanethiol in a preparation of the resin particle dispersion (1) is changed to 4 parts by weight, the toner and developer are produced in the same manner as in Example 1B.

Example 8B

Except that the nitric acid aqueous solution with a polyaluminum chloride concentration of 10% is changed from 30 parts to 55 parts and a temperature for heating again is changed from 60° C. to 62° C., the toner and developer are produced in the same manner as in Example 1B.

Example 9B

Except that the nitric acid aqueous solution with a polyaluminum chloride concentration of 10% is changed from 30 parts to 25 parts and a temperature for heating again is changed from 60° C. to 58° C., the toner and developer are produced in the same manner as in Example 1B.

Example 10B

Except that the hydrophobic silica particles (1) are changed to the hydrophobic silica particles (2), the toner and developer are produced in the same manner as in Example 1B.

Example 11B

Except that the hydrophobic silica particles (1) are changed to the hydrophobic silica particles (3), the toner and developer are produced in the same manner as in Example 1B.

Comparative Example 1B

—Production of Magenta Toner 2—

Resin particle dispersion (1): 402.5 parts
Magenta colored particle dispersion: 12.5 parts
Release agent particle dispersion: 50 parts
Anionic surfactant (TAYCA POWER, manufactured by Tayca Corporation): 2 parts The above materials are put in a round stainless steel flask, and the pH is adjusted to 3.5 by adding 0.1 Nmol/L nitric acid. Then, 30 parts of a nitric acid aqueous solution having a polyaluminum chloride concentration of 10% is added thereto. Next, the mixture is dispersed at 30° C. using a homogenizer (ULTRA TURRAX T50, manufactured by IKA Co., Ltd.), then heated at 45° C. in a heating oil bath, and kept until the volume average particle diameter reaches 5.2 μm. Thereafter, 100 parts of the resin particle dispersion (1) is added thereto and held for 1 hour, and a 0.1 Nmol/L sodium hydroxide aqueous solution is added to adjust the pH to 8.5. Then, the mixture is heated to 85° C. while stirring, and then held for 5 hours. Thereafter, the mixture is cooled to 20° C. at a rate of 20° C./min, filtered, sufficiently washed with ion exchanged water, and dried to obtain toner particles (2) having a volume average particle diameter of 6.5 μm.

In the subsequent external addition step, developer is prepared in the same manner as in Example 1B.

Comparative Example 2B

Except that keeping until the volume average particle diameter reaches 5.2 μm is changed to keeping until the volume average particle diameter reaches 4.1 μm and keeping at 85° C. for 10 hours is changed to keeping at 86° C. to 12 hours, the toner and developer are produced in the same manner as in Example 1B.

Comparative Example 3B

Except that keeping until the volume average particle diameter reaches 5.2 μm is changed to keeping until the volume average particle diameter reaches 10.3 μm and keeping at 85° C. for 10 hours is changed to keeping at 80° C. to 1 hours, the toner and developer are produced in the same manner as in Example 1B.

Comparative Example 4B

Except that keeping until the volume average particle diameter reaches 5.2 μm is changed to keeping until the volume average particle diameter reaches 2.8 μm and keeping at 85° C. for 10 hours is changed to keeping at 86° C. to 6 hours, the toner and developer are produced in the same manner as in Example 1B.

<Evaluation of Color Difference Variation>

As an image forming apparatus for forming images for evaluation, Docu Center Color 400 manufactured by Fuji Xerox Co., Ltd. is prepared and a developer of each example is put into the magenta developing unit. When forming the images, the fixing temperature is 190° C. and the fixing pressure is 4.0 kg/cm$^2$. As the recording medium, a coated sheet (OS coated sheet W, manufactured by Fuji Xerox Co., Ltd) is used. Humidity is conditioned at 35° C. 80% RH for 17 hours, and 100 sheets of Red-halftone images that has an image density of 10% and has a secondary color of magenta and cyan are output. Thereafter, one sheet of test chart No. 5-1 of the imaging society is output. After the humidity is conditioned at 10° C. 15% RH for 17 hours, 50,000 sheets of the same halftone images are output. Thereafter, the humidity is conditioned at 35° C. 80% for 17 hours and 10 sheets of the same halftone images are output. Then, one sheet of the Test Chart No. 5-1 of the imaging society is output. Three points of a chart of a rightmost rose image of the first and second test charts are measured, an average value of an L* value, an a* value, and a b* value is calculated, and the color difference ΔE is calculated by the following equation for evaluation. Evaluation criteria are shown below.

$$\Delta E=\{(L^{*1}-L^{*2})^2+(a^{*1}-a^{*2})^2+(b^{*1}-b^{*2})^2\}^{0.5}$$

The superscript "1" in L*, a*, and b* represents a value of the first test chart and the superscript "2" represents a value of the second test chart. —Evaluation Criteria—

G0: Color difference ΔE is 5 or less

G1: Color difference ΔE is more than 5 and 10 or less

G2: Color difference ΔE is more than 10 and 15 or less

G3: Color difference ΔE is more than 15

The "bulk density" in Table 4 indicates values of a compacted bulk density after storage to a compacted bulk density before storage (Compacted bulk density after storage/Compacted bulk density before storage).

From the results shown in Table 4, it is found that in the electrostatic charge image developing toner of the exemplary embodiments, the color difference of an obtained image is prevented from varying, as compared with the electrostatic charge image developing toner of the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner having a surface property index value represented by Formula S of 2.0 to 2.8:

(Surface property index value)=(Measured value of specific surface area)/(Calculated value of specific surface area) Formula S wherein (Calculated value of specific surface area)=(Sum of surface areas calculated from equivalent circle diameters of 4,500 toner particles in flow particle image analysis)/{(Specific gravity of toner)×(Sum of volumes calculated from equivalent circle diameters of 4,500 toner particles in flow particle image analysis)},

TABLE 4

| | Mw of THF soluble portion of toner | Bulk density | Hydrophobic silica particles Kind | Amount (part) | Volume average particle diameter (nm) | Surface property index value | Calculated value of specific surface area | Color difference variation evaluation |
|---|---|---|---|---|---|---|---|---|
| Example 1B | 34,000 | 0.96 | (1) | 2 | 154 | 1.60 | 0.93 | G0 |
| Example 2B | 35,200 | 0.95 | (1) | 2 | 154 | 1.98 | 0.90 | G1 |
| Example 3B | 33,800 | 0.97 | (1) | 2 | 154 | 1.02 | 1.00 | G0 |
| Example 4B | 34,300 | 0.95 | (1) | 2 | 154 | 1.72 | 0.74 | G1 |
| Example 5B | 35,300 | 0.97 | (1) | 2 | 154 | 1.54 | 1.25 | G1 |
| Example 6B | 65,800 | 0.96 | (1) | 2 | 154 | 1.78 | 0.91 | G1 |
| Example 7B | 25,200 | 0.95 | (1) | 2 | 154 | 1.56 | 0.96 | G0 |
| Example 8B | 33,600 | 0.98 | (1) | 2 | 154 | 1.62 | 0.97 | G0 |
| Example 9B | 34,300 | 0.90 | (1) | 2 | 154 | 1.56 | 0.90 | G1 |
| Example 10B | 34,000 | 0.95 | (2) | 2 | 245 | 1.51 | 0.89 | G0 |
| Example 11B | 34,000 | 0.95 | (3) | 2 | 125 | 1.64 | 0.91 | G1 |
| Comparative Example 1B | 38,500 | 0.94 | (1) | 2 | 154 | 2.10 | 0.91 | G3 |
| Comparative Example 2B | 37,800 | 0.97 | (1) | 2 | 154 | 1.00 | 1.20 | G2 |
| Comparative Example 3B | 38,800 | 0.93 | (1) | 2 | 154 | 1.98 | 0.64 | G3 |
| Comparative Example 4B | 37,500 | 0.98 | (1) | 2 | 154 | 1.09 | 1.35 | G3 |

wherein a melt viscosity of the toner as measured by a flow tester method at a load of 10 kgf/cm$^2$ is from 90° C. to 140° C.

2. The electrostatic charge image developing toner according to claim 1, comprising a binder resin and a release agent.

3. The electrostatic charge image developing toner according to claim 2, wherein when the number of the release agents having an aspect ratio of 5 or more in the toner is taken as a, and the number of the release agents having an aspect ratio of lower than 5 in the toner is taken as b, a relation thereof satisfies $1.0<a/b<8.0$.

4. The electrostatic charge image developing toner according to claim 3, wherein when an area of the release agents having an aspect ratio of 5 or more in a toner section is taken as c, and an area of the release agents having an aspect ratio of lower than 5 in the toner section is taken as d, a relation thereof satisfies $1.0<c/d<4.0$.

5. The electrostatic charge image developing toner according to claim 2, wherein a melting temperature of the release agent is from 65° C. to 100° C.

6. The electrostatic charge image developing toner according to claim 5, wherein the melting temperature of the release agent is from 70° C. to 95° C.

7. The electrostatic charge image developing toner according to claim 1, wherein the melt viscosity of the toner as measured by the flow tester method at a load of 10 kgf/cm$^2$ is from 95° C. to 130° C.

8. An electrostatic charge image developer comprising the electrostatic charge image developing toner according to claim 1.

9. A toner cartridge comprising:

a container that contains the electrostatic charge image developing toner according to claim 1, wherein the toner cartridge is detachable from an image forming apparatus.

* * * * *